US011605258B2

(12) United States Patent
Morita

(10) Patent No.: US 11,605,258 B2
(45) Date of Patent: Mar. 14, 2023

(54) PAPER SHEET PROCESSING DEVICE

(71) Applicants: LAUREL BANK MACHINES CO., LTD., Tokyo (JP); LAUREL MACHINERY CO., LTD., Osaka (JP); LAUREL PRECISION MACHINES CO., LTD., Osaka (JP)

(72) Inventor: Tadaaki Morita, Tokyo (JP)

(73) Assignees: LAUREL BANK MACHINES CO., LTD., Tokyo (JP); LAUREL MACHINERY CO., LTD., Osaka (JP); LAUREL PRECISION MACHINES CO., LTD., Osaka (JP)

( * ) Notice: Subject to any disclaimer, the term of this patent is extended or adjusted under 35 U.S.C. 154(b) by 0 days.

(21) Appl. No.: 17/276,085

(22) PCT Filed: Sep. 3, 2019

(86) PCT No.: PCT/JP2019/034574
§ 371 (c)(1),
(2) Date: Mar. 12, 2021

(87) PCT Pub. No.: WO2020/054505
PCT Pub. Date: Mar. 19, 2020

(65) Prior Publication Data

US 2022/0051505 A1 Feb. 17, 2022

(30) Foreign Application Priority Data

Sep. 13, 2018 (JP) ..... JP2018-171713

(51) Int. Cl.
*B65H 1/14* (2006.01)
*G07D 11/13* (2019.01)
(Continued)

(52) U.S. Cl.
CPC ..... *G07D 11/13* (2019.01); *B65H 1/02* (2013.01); *B65H 1/14* (2013.01); *B65H 3/06* (2013.01);
(Continued)

(58) Field of Classification Search
CPC .... G07D 11/13; G07D 2211/00; G07D 11/50; B65H 1/02; B65H 1/14; B65H 2402/31;
(Continued)

(56) References Cited

U.S. PATENT DOCUMENTS 4,721,382 A 1/1988 Ito et al.
2005/0285329 A1 12/2005 Ikeda
(Continued)

FOREIGN PATENT DOCUMENTS

CN 1712342 A 12/2005
CN 102376123 A 3/2012
(Continued)

OTHER PUBLICATIONS

Notice of Allowance dated Sep. 15, 2021 in Russian Application No. 2021106901, with English translation, 11 pages.
(Continued)

*Primary Examiner* — Thomas A Morrison
(74) *Attorney, Agent, or Firm* — Nixon & Vanderhye P.C.

(57) ABSTRACT

A paper sheet processing device includes: an accommodating part that accommodates a paper sheet; and a sliding stage part that is provided within the accommodating part and supports the paper sheet accommodated within the accommodating part, the sliding stage part sliding with respect to the accommodating part to cause a portion of the sliding stage part to protrude to outside of the accommodating part, and the sliding stage part sliding with respect to the accommodating part to push the paper sheet to the outside of the
(Continued)

accommodating part and cause a leading end of the paper sheet to protrude to the outside of the accommodating part.

6 Claims, 12 Drawing Sheets

(51) Int. Cl.
*B65H 1/02* (2006.01)
*G07D 11/50* (2019.01)
*B65H 3/06* (2006.01)

(52) U.S. Cl.
CPC ..... *B65H 2402/31* (2013.01); *B65H 2405/20* (2013.01); *B65H 2701/1912* (2013.01); *G07D 11/50* (2019.01); *G07D 2211/00* (2013.01)

(58) Field of Classification Search
CPC ..... B65H 2405/20; B65H 2701/1912; B65H 3/06
See application file for complete search history.

(56) References Cited

U.S. PATENT DOCUMENTS

| | | | | |
|---|---|---|---|---|
| 2007/0125622 | A1 | 6/2007 | Yoshioka | |
| 2010/0090393 | A1* | 4/2010 | Ito | B65H 3/0676 271/111 |
| 2010/0148418 | A1* | 6/2010 | Horiuchi | G07D 11/14 271/3.09 |
| 2010/0207319 | A1* | 8/2010 | Sato | G07D 11/50 271/145 |
| 2015/0203319 | A1 | 7/2015 | Suzuki et al. | |
| 2021/0049853 | A1* | 2/2021 | Baranowski | G07D 11/22 |

FOREIGN PATENT DOCUMENTS

| | | | |
|---|---|---|---|
| CN | 107251110 | A | 10/2017 |
| EP | 0 841 191 | A2 | 5/1998 |
| EP | 2 991 047 | A1 | 3/2016 |
| JP | 2000-44107 | A | 2/2000 |
| JP | 2001-026362 | A | 1/2001 |
| JP | 2011-057453 | A | 3/2011 |
| JP | 2013-103818 | | 5/2013 |
| JP | 2017-182312 | | 10/2017 |
| JP | 2018-020853 | | 2/2018 |
| RU | 2 619 730 | C2 | 5/2017 |
| WO | 2009/028072 | | 3/2009 |
| WO | WO 2014/114055 | A1 | 7/2014 |

OTHER PUBLICATIONS

International Search Report for PCT/JP2019/034574 dated Oct. 29, 2019, 4 pages.
Extended European Search Report dated May 19, 2022 in European Application No. 19860645.1, 9 pages.
Chinese Office Action dated Jun. 7, 2022 in Chinese Application No. 201980059549.9, with partial English translation (Search Report), 10 pages.
Korean Office Action dated Dec. 14, 2022 in Korean Application No. 10-2021-7007532, with English translation, 14 pages.

* cited by examiner

PAPER SHEET PROCESSING DEVICE

TECHNICAL FIELD

The present invention relates to a paper sheet processing device.

This application is the U.S. national phase of International Application No. PCT/JP2019/034574 filed Sep. 3, 2019 which designated the U.S. and claims the benefit of priority from Japanese Patent Application No. 2018-171713, filed Sep. 13, 2018, the disclosure of each of which are incorporated herein by reference.

BACKGROUND ART

Conventionally, a paper sheet processing device for processing paper sheets has been proposed. For example, the paper sheet processing device disclosed in Patent Document 1: takes accumulated paper sheets input in the receiving port into the device one by one; identifies the paper sheets taken in from the receiving port by means of an identifying part provided on a transportation path for transporting the paper sheets; and accommodates the paper sheets therein so as to be able to be removed to the outside, while classifying the paper sheets into an accommodating part according to the type thereof identified by the identifying part.

PRIOR ART DOCUMENTS

Patent Documents

[Patent Document 1] Japanese Unexamined Patent Application, First Publication No. 2017-182312

SUMMARY OF INVENTION

Problem to be Solved by the Invention

However, the conventional paper sheet processing device as in Patent Document 1 has a problem that it is difficult to take out the paper sheets accommodated in the accommodating part.

Therefore, an object of the present invention is to provide a paper sheet processing device that facilitates removal of paper sheets.

Means for Solving the Problem

In order to achieve the above objective, a paper sheet processing device according to an aspect of the present invention includes: an accommodating part that accommodates a paper sheet; and a sliding stage part that is provided within the accommodating part and supports the paper sheet accommodated within the accommodating part, the sliding stage part sliding with respect to the accommodating part to cause a portion of the sliding stage part to protrude to outside of the accommodating part, and the sliding stage part sliding with respect to the accommodating part to push the paper sheet to the outside of the accommodating part and cause a leading end of the paper sheet to protrude to the outside of the accommodating part.

Effect of the Invention

According to the present invention, it is possible to provide a paper sheet processing device that facilitates removal of paper sheets.

EMBODIMENTS FOR CARRYING OUT THE INVENTION

First Embodiment

Figure 1:
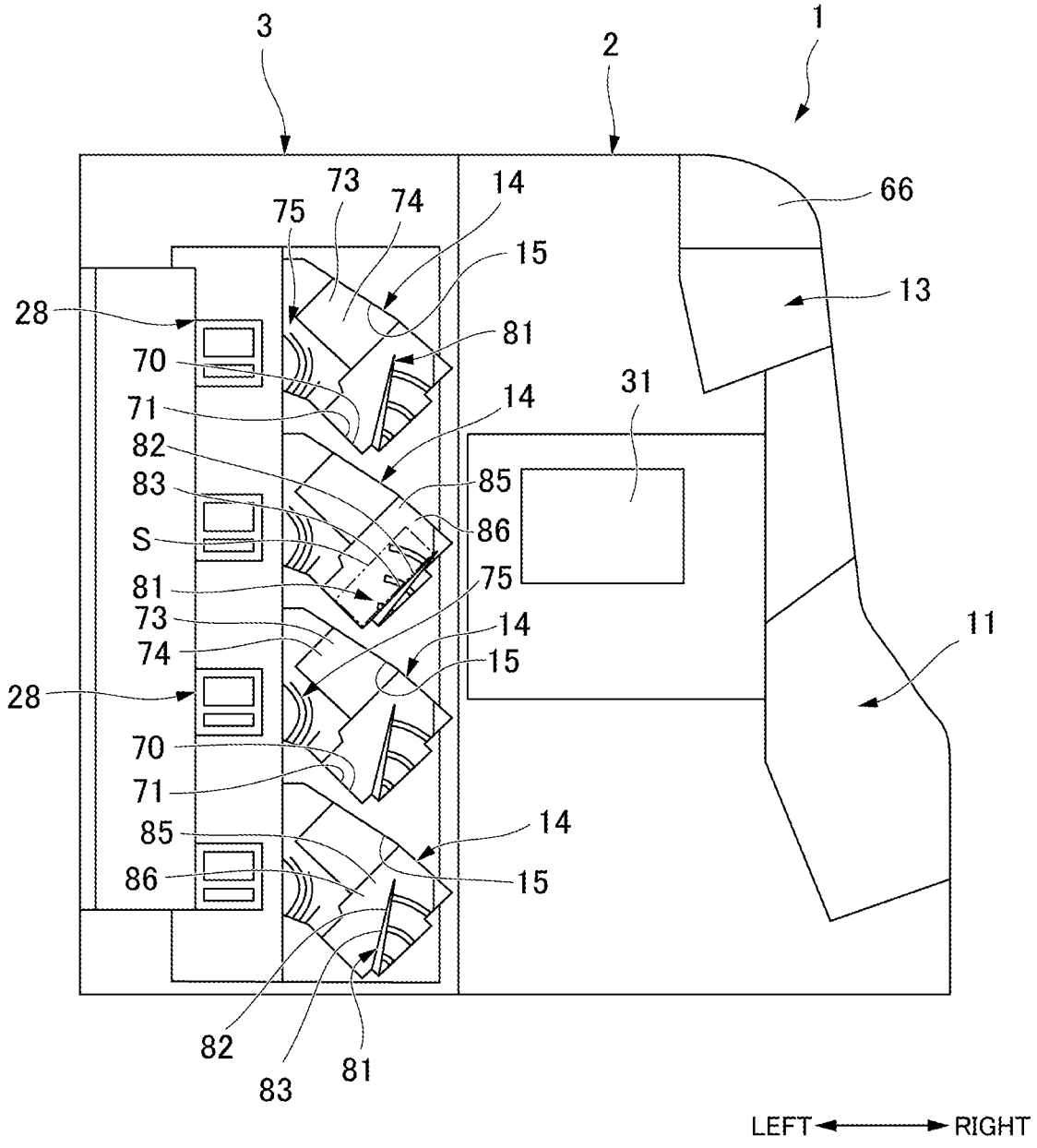
FIG. 1 is a front elevation view showing a paper sheet processing device according to one embodiment of the present invention.
Figure 2:
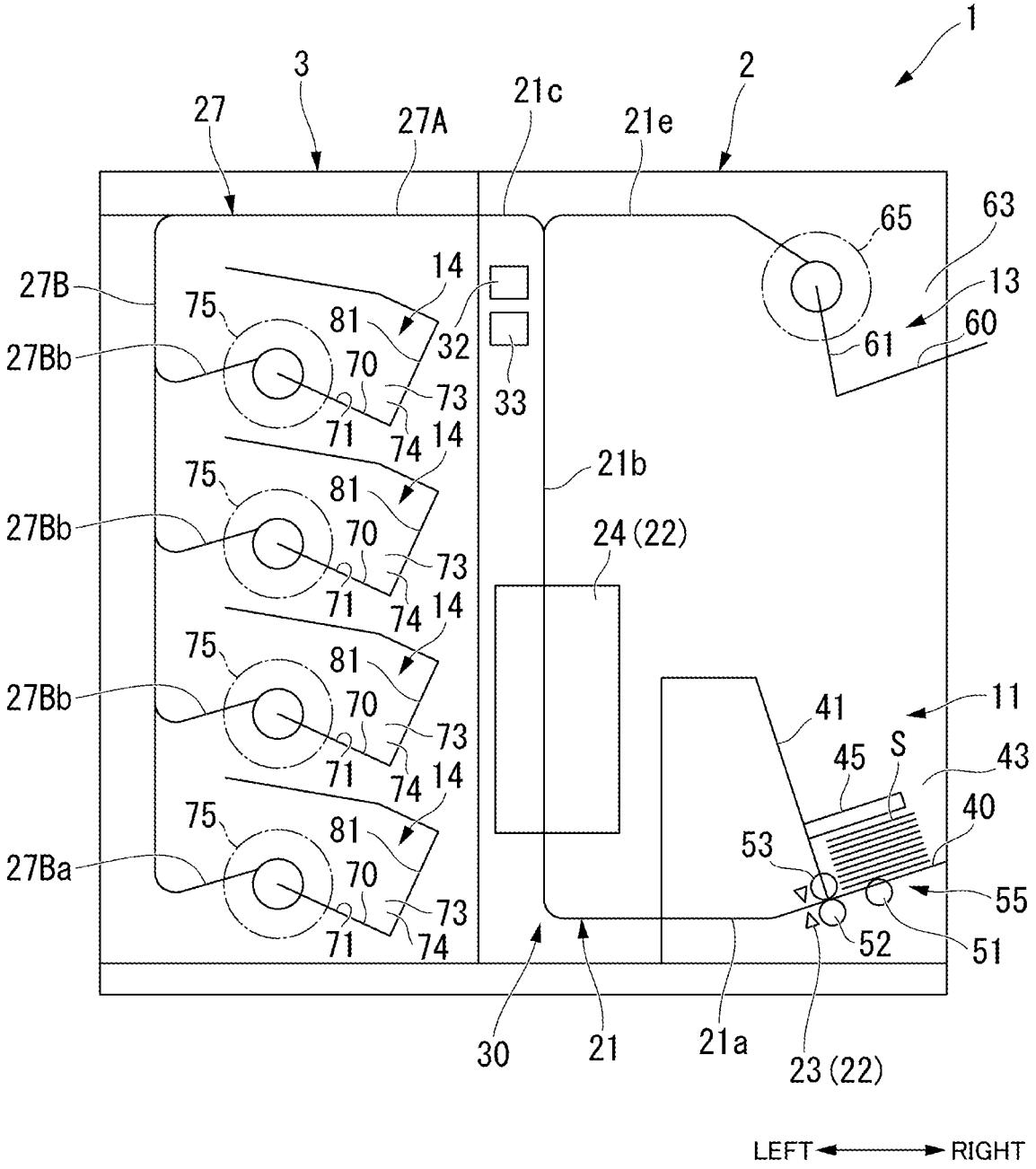
FIG. 2 is a schematic configuration diagram of the interior of the paper sheet processing device according to the one embodiment of the present invention as viewed from the front side.
Figure 3:
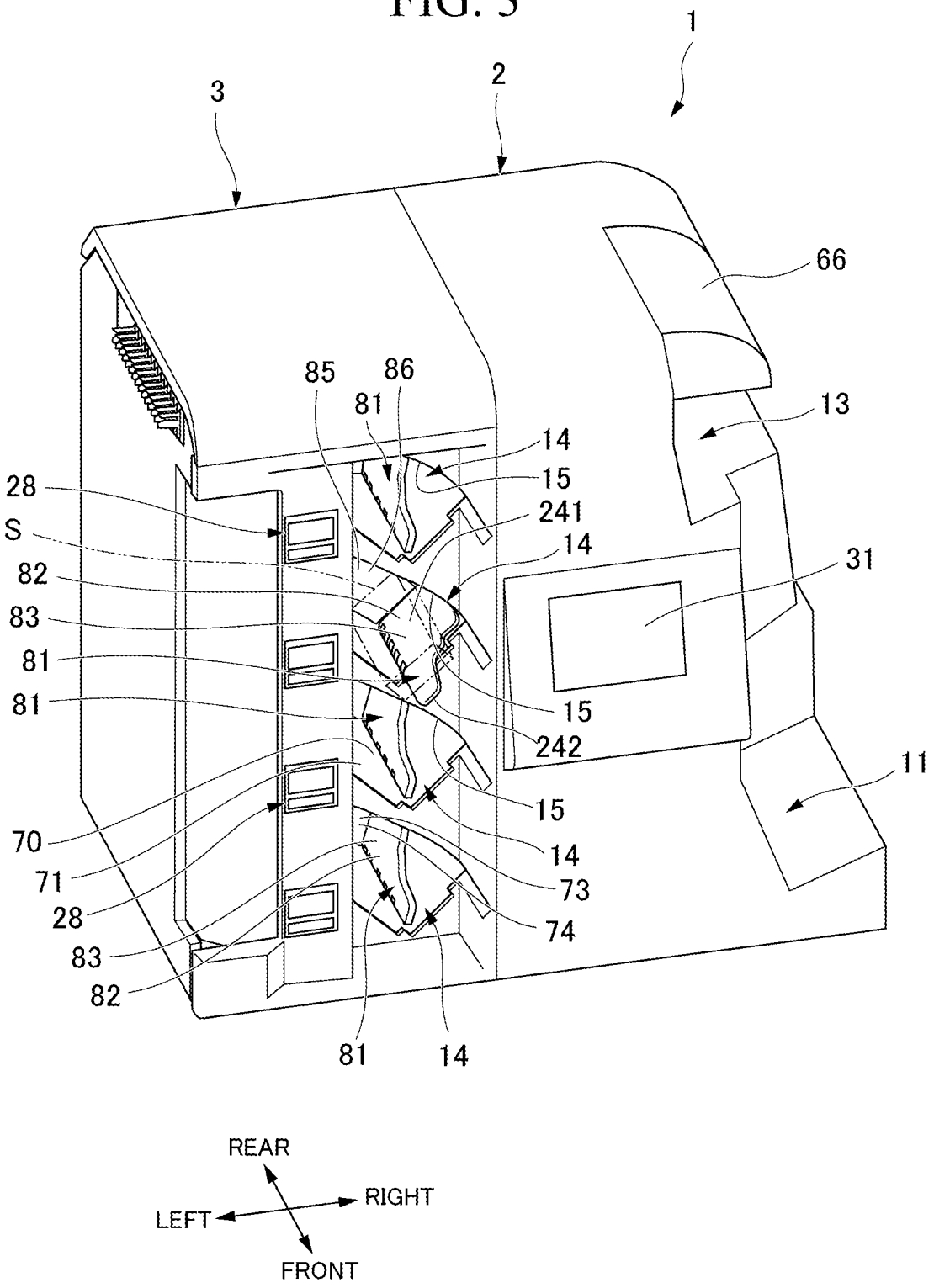
FIG. 3 is a perspective view showing the paper sheet processing device according to the one embodiment of the present invention.

Hereunder, a paper sheet processing device of a first embodiment according to the present invention will be described, with reference to the drawings. FIG. 1 to FIG. 3 show a paper sheet processing device 1 according to the first embodiment. The paper sheet processing device 1 primarily performs processing of classifying banknotes as paper sheets. More specifically, the paper sheet processing device 1 classifies input paper sheets S into counting target paper sheets to be counted and into rejected paper sheets not to be counted. Moreover, the paper sheet processing device counts the target paper sheets by type and accommodates them by type, and displays the counting result and the accommodation destination in association with each other. In the following description, "front" refers to the operator side, "rear" refers to the opposite side of the operator, "right" refers to the right side as viewed from the operator, and "left" refers to the left side as viewed from the operator.

The paper sheet processing device 1 of the first embodiment is configured by combining a counting unit 2 and an accommodating unit 3. Here is described a case as an example where one accommodating unit 3 is combined with one counting unit 2, however, it is not limited to such a configuration. A plurality of accommodating units 3 may be provided continuous to one counting unit 2.

As shown in FIG. 1 and FIG. 3, the counting unit 2 has a receiving part 11 and a rejection part 13. The receiving part 11 is provided at a lower part on the right-side surface side of the counting unit 2, and is always open to the outside of the counting unit 2, that is, the outside of the paper sheet processing device 1, over the right-side surface and the front surface. The rejection part 13 is provided at an upper part on the right-side surface side of the counting unit 2, and is always open to the outside of the counting unit 2, that is, the outside of the paper sheet processing device 1, over the right-side surface and the front surface. The positions of the rejection part 13 and the receiving part 11 in the front-rear direction are the same. The positions of the rejection part 13 and the receiving part 11 in the left-right direction are the same. The rejection part 13 and the receiving part 11 are arranged in line along the vertical direction.

As shown in FIG. 2, a plurality of paper sheets S are set in the receiving part 11 in a state being accumulated in the vertical direction while the long side (long side part) thereof is aligned with the front-rear direction, and the short side (short side part) thereof is aligned with the left-right direction. The receiving part 11 separates the accumulated paper sheets S set in this manner one by one, starting with the bottom-most paper sheet, feeds them out, and takes them into the paper sheet processing device 1. The paper sheet S fed from the receiving part 11 moves along the extending direction of the short side thereof.

The counting unit 2 has, inside a casing thereof, an in-counting-unit transport constituent part 21 and an identification part 22. The in-counting-unit transport constituent part 21 transports paper sheets S fed from the receiving part 11. The identification part 22 counts the paper sheets S while identifying the paper sheets S being transported in the in-counting-unit transport constituent part 21. The paper sheets S transported in the in-counting-unit transport constituent part 21 move along the extending direction of the short side thereof. The identification part 22 has a detection part 23 and an identification main body part 24. The detection part 23 is provided at an end part position of the in-counting-unit transport constituent part 21 on the receiving part 11 side, and detects the transporting state of the paper sheets S being fed by the receiving part 11. The identification main body part 24 is provided on the downstream side of the detection part 23 of the in-counting-unit transport constituent part 21, and performs a process different from the detection of the transporting state of paper sheets S, specifically, a process of identifying the type of paper sheets S such as a denomination.

The in-counting-unit transport constituent part 21 has a left extended part 21*a*, an upper extended part 21*b*, a left extended part 21*c*, and a branch extended part 21*e*. The left extended part 21*a* extends from the receiving part 11 toward the left-side surface of the counting unit 2. The upper extended part 21*b* extends upward from an end part near the left-side surface of the left extended part 21*a*. The left extended part 21*c* extends from an upper end part of the upper extended part 21*b* toward the left-side surface of the counting unit 2 and opens to the left-side surface. The branch extended part 21*e* branches on the upper side of the identification part 22 of the upper extended part 21*b*, extends toward the right-side surface of the counting unit 2, and connects to the rejection part 13. In the in-counting-unit transport constituent part 21, the identification main body part 24 of the identification part 22 is provided on the upper extended part 21*b* along the vertical direction.

Inside the accommodating unit 3, there is provided an in-accommodating-unit transport constituent part 27. The in-accommodating-unit transport constituent part 27 is connected to the left extended part 21*c* of the counting unit 2 and transports the paper sheets S fed from the left extended part 21*c*. The paper sheets S being transported in the in-accommodating-unit transport constituent part 27 also move along the extending direction of the short side thereof.

The in-accommodating-unit transport constituent part 27 has a connection transport constituent part 27A and a branch transport constituent part 27B. The connection transport constituent part 27A opens to an upper part of the right-side surface of the accommodating unit 3, extends horizontally and linearly toward the left-side surface of the accommodating unit 3, and opens to an upper part of the left-side surface. The branch transport constituent part 27B branches from the left side portion of the connection transport constituent part 27A to the lower side. The connection transport constituent part 27A and the branch transport constituent part 27B each have a separate driving motor and the driving motors can be driven independently of each other. Here is described a case where a plurality of accommodating units 3 are provided in a continuous manner with respect to one counting unit 2. In such a case, the plurality of accommodating units 3 are arranged connected in line along the left-right direction. One of the plurality of accommodating units 3 is directly connected to the connection transport constituent part 27A. The other accommodating units 3 are connected to the connection transport constituent part 27A via the adjacent accommodating unit 3.

The branch transport constituent part 27B has a lower extended part 27Ba and a plurality of, specifically, three branch extended parts 27Bb. The lower extended part 27Ba branches from the left side of the connection transport constituent part 27A and extends vertically downward. The end part of the lower extended part 27Ba opposite to the connection transport constituent part 27A extends toward the right-side surface of the accommodating unit 3. The three branch extended parts 27Bb branch from intermediate positions of the lower extended part 27Ba and extend toward the right-side surface of the accommodation unit 3. Accommodating parts 14 for accumulating paper sheets S and accommodating them in the interior (internal space) thereof are connected to the terminal part of the lower extended part 27Ba and to the three branch extended parts 27Bb, respectively. Therefore, one accommodating unit 3 is provided with a plurality, specifically, four accommodating parts 14.

As shown in FIG. 1 and FIG. 3, each of the plurality of accommodating parts 14 has an opening part 15 provided in the front surface of the accommodating unit 3, that is, the front surface of the paper sheet processing device 1. The plurality of accommodating parts 14 are, at each opening part 15, always open to the outside of the accommodating part 3, that is, the outside of the paper sheet processing device 1. A plurality of, specifically, four status display parts 28 are provided on the front surface of the accommodating unit 3, that is, the front surface of the paper sheet processing device 1. The four status display parts 28 each correspond to the four accommodating parts 14 in a one-to-one manner. The height-wise position of each status display part 28 is aligned with the height-wise position of the corresponding accommodating part 14. Each status display part 28 is positioned on the left side of the corresponding accommodating part 14. Each status display part 28 displays the number or the like of paper sheets S accumulated in the corresponding accommodating part 14.

The positions of the plurality of accommodating parts 14 in the front-rear direction are the same. Also, the positions of the plurality of accommodating parts 14 in the left-right direction are the same. The plurality of accommodating parts 14 are arranged in line at predetermined intervals in the vertical direction (height direction). The positions of the plurality of accommodating parts 14 in the front-rear direction align with the positions of the receiving part 11 and the rejection part 13 provided in the counting unit 2.

As shown in FIG. 2, the in-counting-unit transport constituent part 21 and the in-accommodating-unit transport constituent part 27, which are connected to each other, constitute a transport part 30 for transporting the paper sheets S fed from the receiving part 11. When the paper sheets S are identified by the identification part 22 while being transported by the transport part 30, the portion of the transport part 30 on the downstream side of the identification part 22 sorts the paper sheets S selectively into one of the rejection part 13 and the plurality of accommodating parts 14, on the basis of the identification result of the identification part 22.

In the paper sheet processing device 1, the rejection part 13 and the plurality of accommodating parts 14 classify the paper sheets S on the basis of the identification result of the identification part 22 and accommodate them to be able to be removed to the outside of the paper sheet processing device 1. As shown in FIG. 1 and FIG. 3, in the plurality of accommodating parts 14, the paper sheets S are pulled out from the opening part 15 provided in the front surface of the paper sheet processing device 1 toward the front of the paper sheet processing device 1.

As shown in FIG. 2, among the paper sheets S taken into the paper sheet processing device 1 by the receiving part 11, the paper sheets S identified by the identification part 22 as rejected paper sheets, which are paper sheets other than counting target paper sheets, are transported to the rejection part 13. The rejection part 13 accepts the transported paper sheets S, and accommodates the accumulated paper sheets S so as to be able to be removed to the outside of the paper sheet processing device 1. The in-counting-unit transport constituent part 21 feeds the paper sheets S out to the rejection part 13. The rejection part 13 accumulates the paper sheets S being fed out in this manner from bottom to top in the feeding out order (in other words, the order of the receiving part 11 taking the sheets in). When fed from the branch extended part 21e of the in-counting-unit transport constituent part 21 out to the rejection part 13, the paper sheets S are accumulated from bottom to top while the long sides thereof are aligned with the front-rear direction and the short sides thereof are aligned with the left-right direction in the rejection part 13.

Among the paper sheets S taken into the paper sheet processing device 1 by the receiving part 11, the paper sheets S identified by the identification part 22 as counting target paper sheets and counted by type are transported to the plurality of accommodating parts 14 by type. The plurality of accommodating parts 14 accept the transported paper sheets S, and accommodate the accumulated paper sheets S so as to be able to be removed to the outside of the paper sheet processing device 1. The in-accommodating-unit transport constituent part 27 feeds the paper sheets S out to one of the plurality of accommodating parts 14 according to the type of paper sheets S. Each accommodating part 14 accumulates the paper sheets S being fed out in this manner in the direction from bottom right to top left in the feeding out order (in other words, the order of the receiving part 11 taking the sheets in).

As shown in FIG. 1 and FIG. 3, an operation display part 31 is provided on the front surface of the counting unit 2 of the paper sheet processing device 1. The operation display part 31 accepts operation inputs and displays various types of information. Moreover, as shown in FIG. 2, a control part 32 and a memory storage part 33 are provided inside the counting unit 2. The control part 32 controls each part of the counting unit 2 and the acconmodating unit 3 connected to the counting unit 2. The memory storage part 33 stores master data serving as an identification reference, data of identification count results, and so forth.

As described above, the receiving part 11 is provided so as to be always open to the right and to the front on the right-side surface of the paper sheet processing device 1. The receiving part 11 has a bottom part 40, a wall part 41, and a wall part 43. The bottom part 40 is arranged so as to be slightly inclined downward to the left with respect to the horizontal direction. The wall part 41 extends upward from the left end position of the bottom part 40 so as to be perpendicular to the bottom part 40. The wall part 43 extends vertically upward from the rear end edge part of the bottom part 40. The bottom part 40 and the wall part 41 extend in the front-rear direction, and the wall part 43 extends in the vertical direction and in the left-right direction. The bottom part 40, the wall part 41, and the wall part 43 are arranged perpendicular to each other. The paper sheets S are accumulated in the receiving part 11 with one long side thereof being in contact with the wall part 41 and one short side thereof being in contact with the wall part 43, and are set on the bottom part 40. The receiving part 11 has a bill press 45. The bill press 45 is provided above the bottom part 40 and moves up and down along the wall part 41. The bill press 45 presses the paper sheets S placed on the bottom part 40 toward the bottom part 40.

The receiving part 11 has a kicking roller 51, a taking-in roller 52, and a separating roller 53. The kicking roller 51 kicks the bottom-most paper sheet S of the paper sheets S set on the bottom part 40 toward the in-counting-unit transport constituent part 21 on the left. The taking-in roller 52 takes in the paper sheet S kicked out by the kicking roller 51 into the paper sheet processing device 1 and delivers it to the in-counting-unit transport constituent part 21. The separating roller 53 separates the paper sheets S one by one to be taken in by the taking-in roller 52. The kicking roller 51, the taking-in roller 52, and the separating roller 53 form a taking-in part 55 that separates the paper sheets S set in the receiving part 11 one by one and takes them into the paper sheet processing device 1.

The detection part 23 of the identification part 22 mentioned above is arranged at a position in the vicinity of the receiving part 11 in the left extended part 21*a* of the in-counting-unit transport constituent part 21, and detects whether or not paper sheets S are being fed out and the state of transporting paper sheets S. The detection part 23 detects the presence or absence of double feeding on the basis of the light transmittance or the physical thickness of the paper sheet S. The detection part 23 detects the presence or absence of skew from the difference in detection timing on both sides of the paper sheet S in the long side direction. The detection part 23 detects the presence or absence of near feeding on the basis of the intervals between the detection tunings of the adjacent paper sheets S. The paper sheets S detected by the detection part 23 as having no double feeding, no skewing, and no near feeding are, in other words, paper sheets S detected by the detection part 23 as being normally transported.

The identification main body part 24 of the identification part 22 detects images of a paper sheet S when irradiated with visible light and when irradiated with ultraviolet rays, and compares each detected image with reference data. The identification main body part 24 identifies the type of the paper sheet S as the type of reference data determined as matching the image of the paper sheet S. The paper sheet S, the type of which has been specified in this manner, is a paper sheet S that has no identification abnormality. On the other hand, when there is no reference data determined to match the image of the paper sheet S, the identification main body part 24 identifies the paper sheet S as a paper sheet S having an identification abnormality.

The rejection part 13 has a bottom part 60, a wall part 61, and a wall part 63. The bottom part 60 is arranged so as to be slightly inclined downward to the left with respect to the horizontal direction. The wall part 61 extends upward from the left end position of the bottom part 60 so as to be substantially perpendicular to the bottom part 60. The wall part 63 extends vertically upward from the rear end edge part of the bottom part 60. The bottom part 60 and the wall part 61 extend in the front-rear direction, and the wall part 63 extends in the vertical direction and in the left-right direction.

An impeller 65 is provided at the upper part of the wall part 61. The impeller 65 is provided in the vicinity of the terminal position of the branch extended part 21e of the in-counting-unit transport constituent part 21, and feeds out paper sheets S transported by the branch extended part 21e to be accumulated on the bottom part 60. The impeller 65 rotates together with the paper sheet S transported by the branch extended part 21*e* while sandwiching it between the blades, and pushes, by means of the blades, the paper sheet S toward the bottom part 60 side, that is, downward when the paper sheet S comes in contact with the wall part 61 and leaves from between the blades.

The rejection part 13 has a paper sheet presence/absence detection sensor (not shown in the drawings) that detects the presence or absence of paper sheets S in the rejection part 13, and a presence/absence indicator lighting (not shown in the drawings) that can switch the lighting state on the basis of the detection result of the paper sheet presence/absence detection sensor. The presence/absence indicator lighting is lit when the presence of paper sheets S in the rejection part 13 is detected by the paper sheet presence/absence detection sensor, and is not lit when an absence of paper sheets S in the rejection part 13 is detected by the paper sheet presence/absence detection sensor. Moreover, the presence/absence indicator lighting blinks, for example, when the rejection part 13 is in the state of being full of paper sheets S.

The presence/absence indicator lighting is provided, for example, on the bottom part 60 so as to emit light outward at the front surface position and right side position of the counting unit 2, that is, the paper sheet processing device 1. The presence/absence indicator lighting may be provided on a cover 66 shown in FIG. 1 and FIG. 3. In such a case, the cover 66 may be made of a transparent material so that the entire cover 66 is illuminated. The cover 66 guides paper sheets S fed out by the impeller 65 and collects them on the bottom part 60.

Each of the plurality of accommodating parts 14 has the same configuration, and has an opening part 15, an accommodating bottom part 70, and an accommodating back wall part 73. The opening part 15 opens to the front surface of the paper sheet processing device 1. The accommodating bottom part 70 is inclined downward to the right with respect to the horizontal direction. The accommodating back wall part 73 extends on the rear side of the accommodating bottom part 70. The accommodating bottom part 70 has an upper surface 71 that faces upwards thereof. The upper surface 71 is inclined downward to the right and extends in the front-rear direction. The accommodating back wall part 73 has a back wall surface 74 facing forward thereof. The back wall surface 74 extends in the vertical direction and the left-right direction. In other words, the back wall surface 74 extends in a direction orthogonal to the front-rear direction.

The accommodating unit 3 has a sliding stage part 81 arranged inside each of the accommodating parts 14. The sliding stage part 81 is provided so as to be able to slide with respect to the accommodating part 14 between a retraction end position at which the entire sliding stage part 81 is arranged in the accommodating part 14 and an advancement end position at which a part of the sliding stage part 81 projects from the opening part 15 of the accommodating part 14. In the example shown in FIG. 3, the first, third, and fourth sliding stage parts 81 from the top in FIG. 3 are positioned at the retraction end position. The second sliding stage part 81 from the top in FIG. 3 is positioned at the advancement end position. When positioned at the retraction end position, the sliding stage part 81 is in a waiting state where it accepts paper sheets S. When positioned at the advancement end position, the sliding stage part 81 is in a push-out state where it pushes out the accommodated paper sheets S forward.

Figure 4:
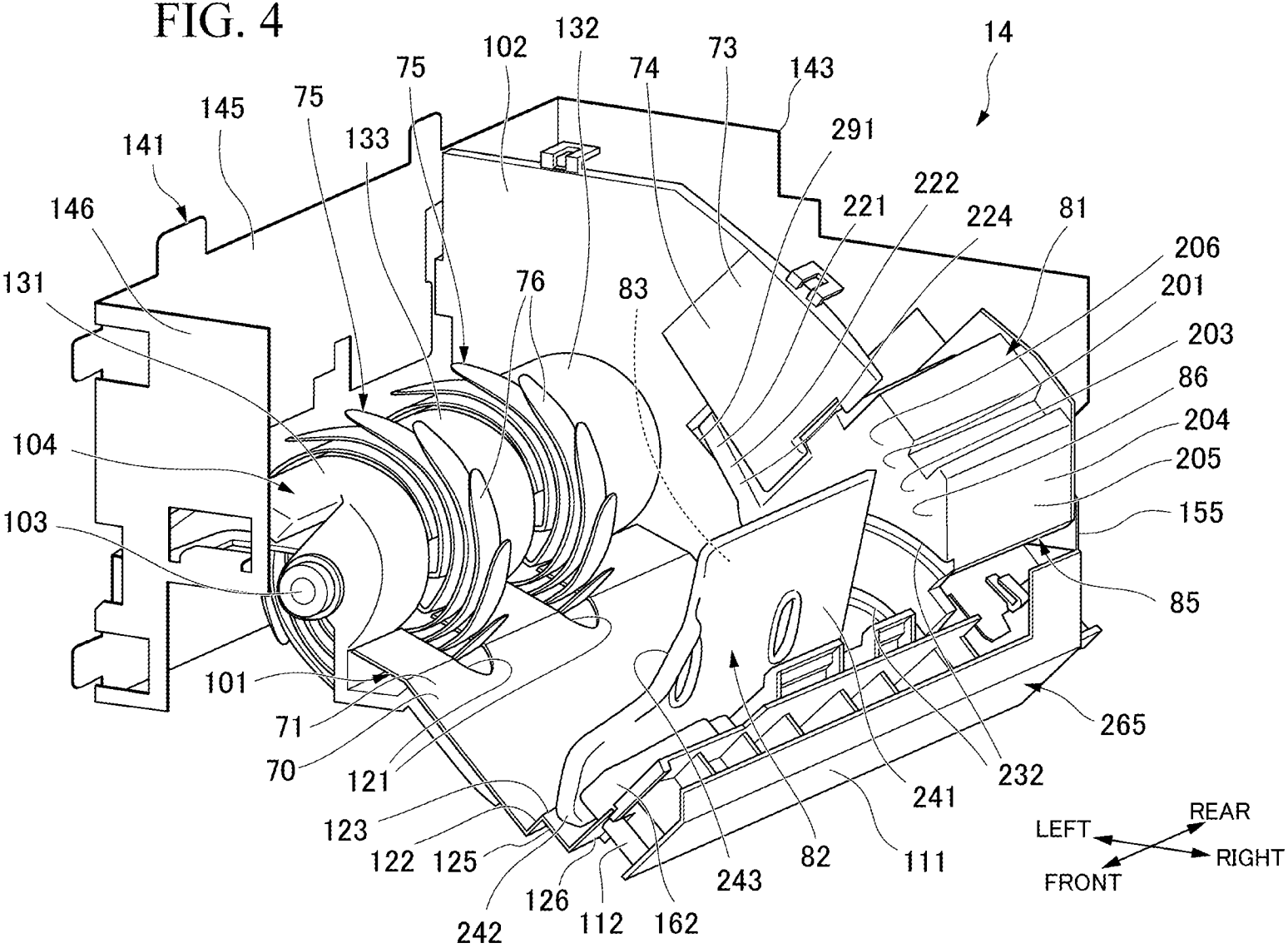
FIG. 4 is a perspective view showing an accommodating part and a sliding stage part of the paper sheet processing device according to the one embodiment of the present invention.
Figure 5:
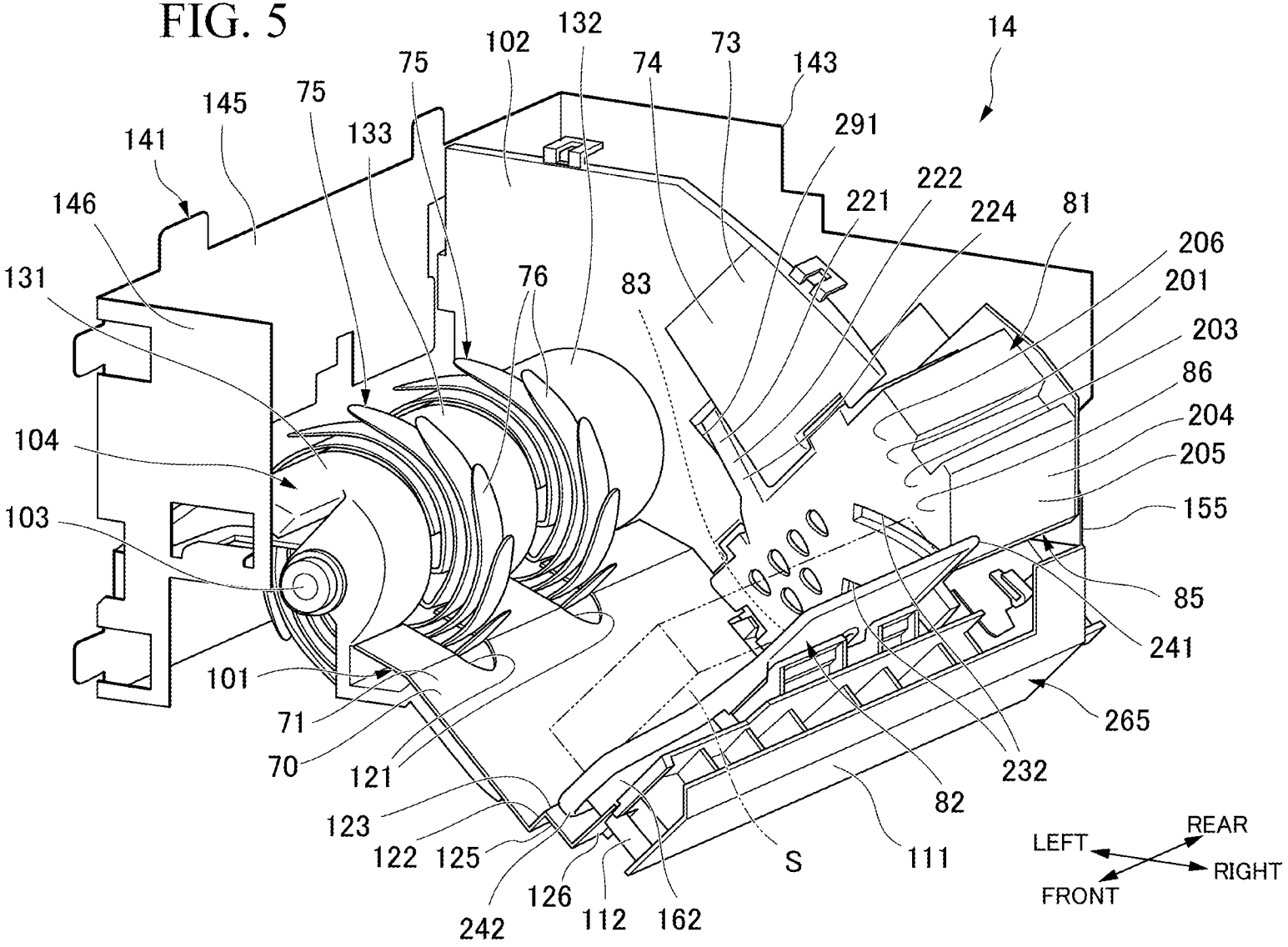
FIG. 5 is a perspective view showing the accommodating part and the sliding stage part of the paper sheet processing device according to the one embodiment of the present invention.
Figure 6:
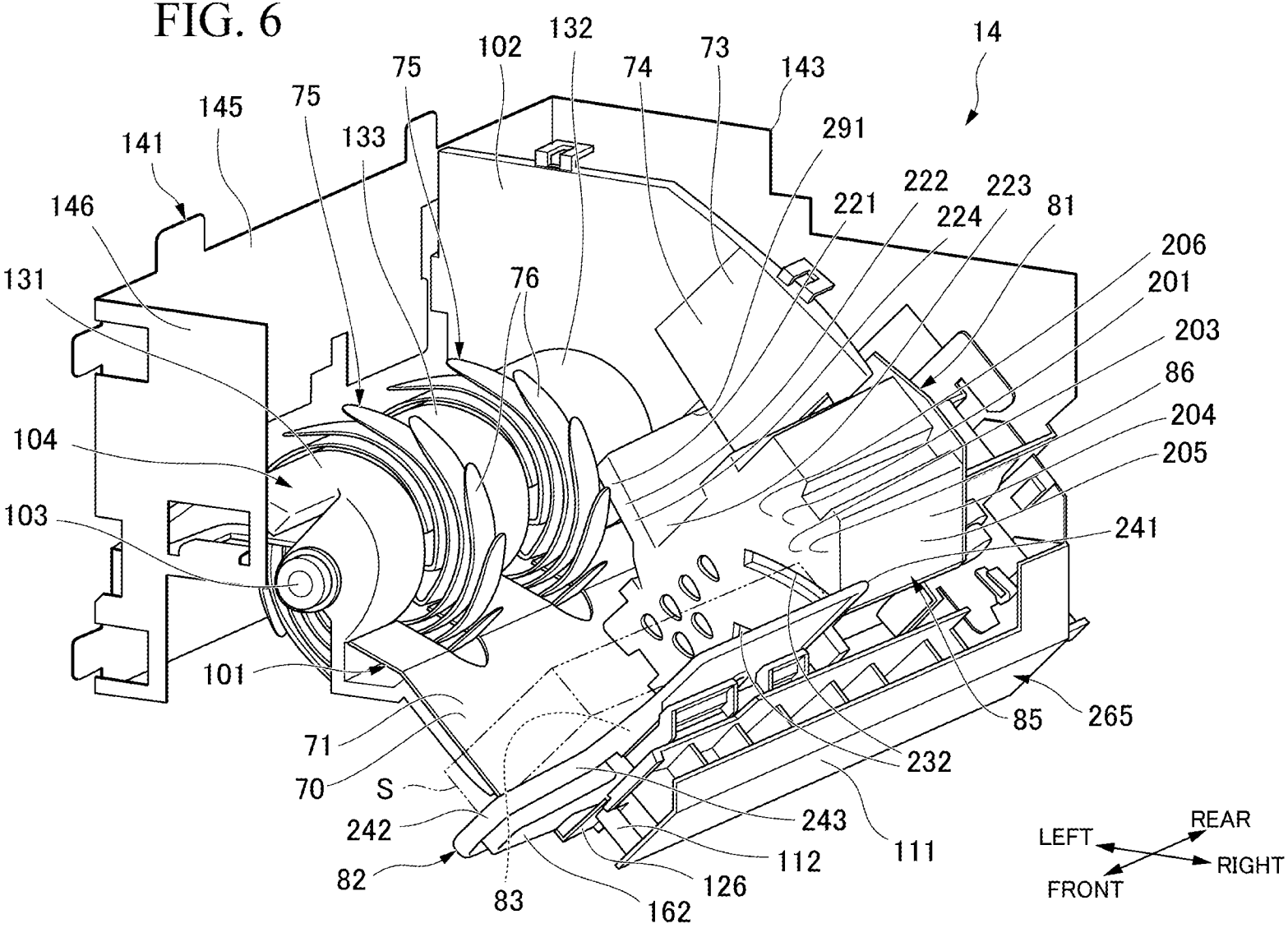
FIG. 6 is a perspective view showing the accommodating part and the sliding stage part of the paper sheet processing device according to the one embodiment of the present invention.

As shown in FIG. 4 to FIG. 6, the sliding stage part 81 has a supporting stage 82 and a push-out stage 85. The supporting stage 82 extends upward to the right from the right end position of the accommodating bottom part 70. The push-out stage 85 is provided on the rear side of the supporting stage 82. The supporting stage 82 has a supporting surface 83 facing the accommodating bottom part 70 side. The supporting surface 83 is inclined upward to the right and extends in the front-rear direction. The push-out stage 85 has a push-out surface 86 that is a front surface facing forward thereof. The push-out surface 86 extends in the vertical direction and in the horizontal direction on the rear side of the supporting stage 82. In other words, the push-out surface 86 extends in the direction orthogonal to the front-rear direction. The back wall surface 74 of the accommodating back wall part 73 and the push-out surface 86 of the push-out stage 85 extend in the direction substantially orthogonal to the upper surface 71 of the accommodating bottom part 70 and the supporting surface 83 of the supporting stage 82. When the sliding stage part 81 is in the waiting state as shown in FIG. 4 and FIG. 5, the push-out surface 86 of the push-out stage 85 is arranged substantially flush with the back wall surface 74 of the accommodating back wall part 73.

As shown in FIG. 2, the impeller 75 is provided at the terminal position of the lower extended part 27Ba of the branch transport constituent part 27B, and at the terminal position of each branch extended part 27Bb. Each impeller 75 feeds out the paper sheets S into the corresponding accommodating part 14. As shown in FIG. 4 to FIG. 6, the impellers 75 are provided on the side opposite to the supporting stage 82 of the accommodating bottom part 70 in the accommodating part 14, that is, on the left side. The impeller 75 has a number of impeller blades 76 provided at predetermined equal intervals in the circumferential direction and extending on the same side in the circumferential direction. The impeller 75 rotates so that the portion opposed to the supporting stage 82 moves from the upper side to the lower side. In the state where the impeller blade 76 faces the supporting stage 82, the fixed end thereof is positioned on the lower side and the free end thereof is positioned on the upper side.

The impeller 75 rotates together with a paper sheet S while sandwiching the paper sheet S that is transported from the left side to the right side by the branch transport constituent part 27B, between the blades 76 positioned at the upper part. When the paper sheet S comes in contact with the upper surface 71 of the accommodating bottom part 70 and comes out from between the blades 76, the impeller 75 pushes the paper sheet S toward the supporting stage 82 side by means of the blades 76. At this time, the paper sheet S is supported by the accommodating bottom part 70 in the state where the short side thereof is substantially aligned with the vertical direction and the long side of the lower end thereof is in contact with the upper surface 71 of the accommodating bottom part 70, and the paper sheet S is guided by the upper surface 71 and moves toward the supporting surface 83 side of the supporting stage 82. As a result, the paper sheet S is supported by the supporting stage 82 in the state where the surface thereof on one side in the thickness direction overlaps with the supporting surface 83 of the supporting stage 82. As with the previously fed out paper sheet S, the paper sheet S fed out next: is supported by the accommodating bottom part 70 in the state where the short side thereof is substantially aligned with the vertical direction and the long side of the lower end thereof is in contact with the upper surface 71 of the accommodating bottom part 70; and moves to the supporting surface 83 side of the supporting stage 82 while being guided by the upper surface 71. As a result, the paper sheet S is supported by the supporting stage 82 in the state where the surface on one side thereof in the thickness direction overlaps with the surface on the other side in the thickness direction of the paper sheet S having already been supported by the supporting stage 82. In this manner, the paper sheets S are sequentially accumulated in the thickness direction and placed on the supporting surface 83 of the supporting stage 82. Although not shown in the drawings, each of the plurality of accommodating parts 14 is also provided with a paper sheet presence/absence detection sensor and a presence/absence indicator lighting similar to those of the rejection part 13. For example, the presence/absence indicator lighting of the accommodating part 14, on the accommodating bottom part 70, emits light outward from a front surface position of the accommodating unit 3, that is, the paper sheet processing device 1.

As shown in FIG. 4 to FIG. 6, the accommodating part 14 has a bottom part constituent member 101, a back wall part constituent member 102, two of the impellers 75 mentioned above, an impeller supporting shaft 103, and a supporting shaft supporting member 104. The bottom part constituent member 101 is a sheet metal component and has the accommodating bottom part 70 including the upper surface 71 mentioned above. The back wall part constituent member 102 is made of a synthetic resin, and has an accommodating back wall part 73 including the back wall surface 74 mentioned above. The impeller supporting shaft 103 supports the two impellers 75. The supporting shaft supporting member 104 is made of synthetic resin and rotatably supports the impeller supporting shaft 103.

The bottom part constituent member 101 is fixed to the sliding stage part supporting member 111 via the connection member 112. The supporting shaft supporting member 104 is fixed to the bottom part constituent member 101. The sliding stage part supporting member 111 is a sheet metal component, and is provided in a state where the position thereof is fixed within the paper sheet processing device 1. Therefore, the bottom part constituent member 101 and the supporting shaft supporting member 104 fixed to the sliding stage part supporting member 111 are also provided in the state where the positions thereof are fixed within the paper sheet processing device 1. The supporting shaft supporting member 104 is fixed also to the back wall part constituent member 102.

The two impellers 75 are supported by the impeller supporting shaft 103 supported by the supporting shaft supporting member 104 and the impeller supporting shaft 103 and are attached at a predetermined interval in the axial direction of the impeller supporting shaft 103. The two impellers 75 are rotatably provided in a state where the positions thereof are fixed within the paper sheet processing device 1. The back wall part constituent member 102 is also provided in the state where the position thereof is fixed within the paper sheet processing device 1.

The bottom part constituent member 101 has the accommodating bottom part 70, a plurality of relief grooves 121, a supporting wall part 122, an extended part 125, and an attachment part 126. The accommodating bottom part 70 includes the upper surface 71 mentioned above. The number of relief grooves 121 is the same as the number of the impellers 75, that is, two. Each relief groove 121 is formed at the impeller 75 side end part of the accommodating bottom part 70, and is a through hole for preventing interference between the bottom part constituent member 101 and the impeller 75. The supporting wall part 122 rises perpendicularly to the accommodating bottom part 70 from the edge part of the accommodating bottom part 70 opposite to the relief groove 121. The extended part 125 extends from the edge part of the supporting wall part 122 opposite to the accommodating bottom part 70 in parallel with the accommodating bottom part 70 and in the direction opposite to the accommodating bottom part 70. The attachment part 126 extends from the edge part of the extended part 125 opposite to the supporting wall part 122 in parallel with the supporting wall part 122 and in the direction opposite to the supporting wall part 122. An upper surface 123 of the supporting wall part 122 is connected to the upper surface 71 of the accommodating bottom part 70 and extends in a direction perpendicular to the upper surface 71. The connection member 112 is attached to the attachment part 126 of the bottom part constituent member 101. The bottom part constituent member 101 is attached to the sliding stage part supporting member 111 via the connection member 112.

Figure 7:
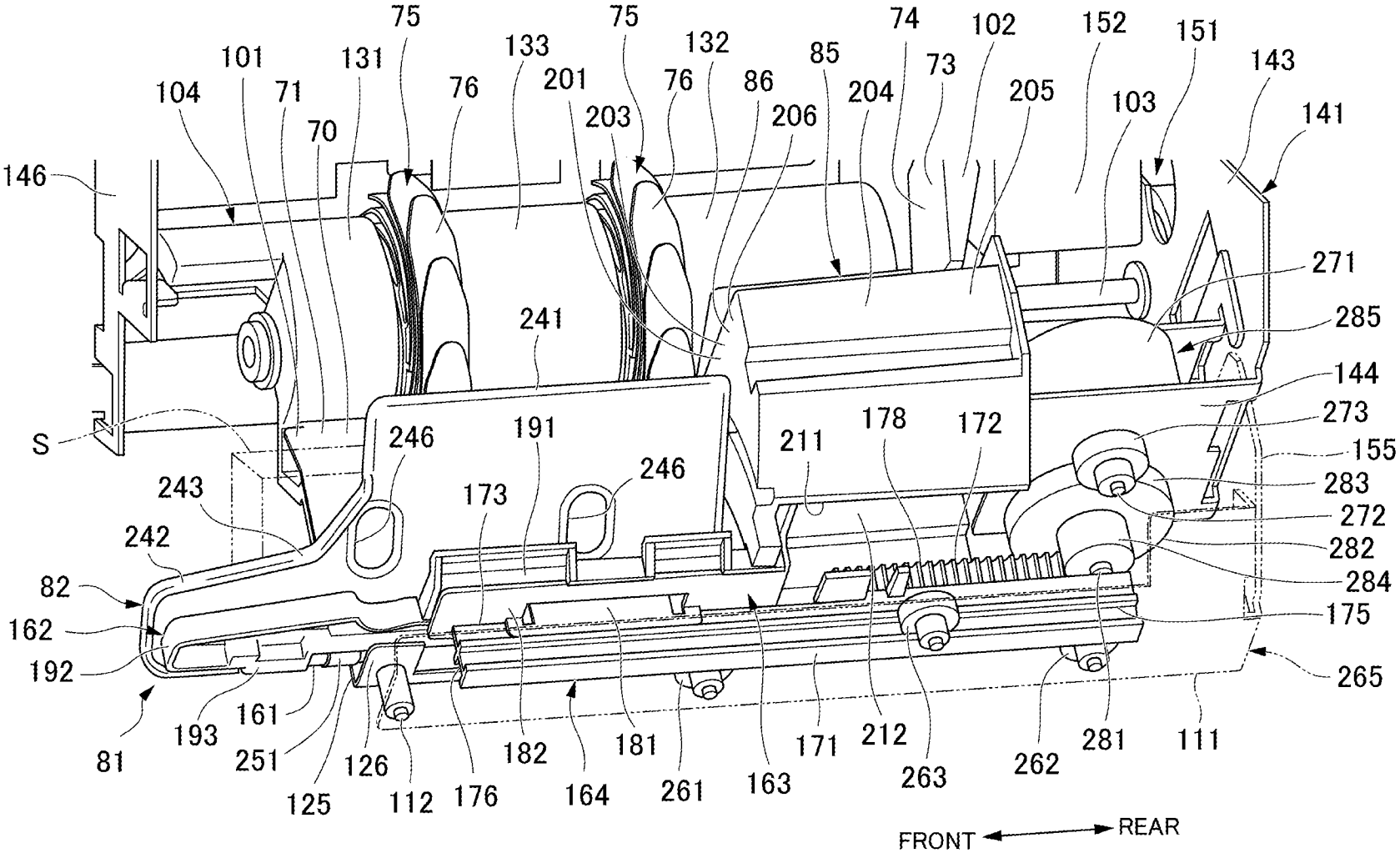
FIG. 7 is a partial perspective view showing the accommodating part and the sliding stage part of the paper sheet processing device according to the one embodiment of the present invention.

The supporting shaft supporting member 104 has a shaft protection part 131, a shaft protection part 132, and a shaft protection part 133. The shaft protection part 131 rotatably supports the impeller supporting shaft 103 and covers the impeller supporting shaft 103 on the side of one impeller 75 opposite to the other impeller 75. The shaft protection part 132 covers the impeller supporting shaft 103 on the side of the other impeller 75 opposite to the one impeller 75. The shaft protection part 133 is provided between the two impellers 75 and covers the impeller supporting shaft 103. As shown in FIG. 7, the impeller supporting shaft 103 is rotatably supported also by a peripheral supporting member 141. The peripheral supporting member 141 is a sheet metal component, and is provided in a state where the position thereof is fixed within the paper sheet processing device 1.

The peripheral supporting member 141 has a shaft supporting plate part 143, a drive system supporting plate part 144, an intermediate extended plate part 145, and a leading end extended plate part 146. The shaft supporting plate part 143 supports the impeller supporting shaft 103. The drive system supporting plate part 144 extends from one edge part of the shaft supporting plate part 143 in a direction perpendicular to the shaft supporting plate part 143. As shown in FIG. 4 to FIG. 6, the intermediate extended plate part 145 extends in a direction perpendicular to the shaft supporting plate part 143 from the other edge part of the shaft supporting plate part 143 opposite to the drive system supporting plate part 144. The leading end extended plate part 146 extends in parallel with the shaft supporting plate part 143 from the edge part of the intermediate extended plate part 145 opposite to the shaft supporting plate part 143 so as to face the shaft supporting plate part 143.

As shown in FIG. 7, on the rear side of the shaft supporting plate part 143, there is provided an impeller transmission part 151 composed of a plurality of gears or the like. To the front side of the shaft supporting plate part 143, there is attached via the impeller transmission part 151, the impeller supporting shaft 103, that is, an impeller driving motor 152. In other words, the impeller transmission part 151 transmits the driving force of the impeller driving motor 152 to the impellers 75. The impeller driving motor 152 is a stepping motor that rotates the impellers 75. When the impeller 75 is driven by the impeller driving motor 152, the blades 76 rotate in a direction of passing through the relief groove 121 of the bottom part constituent member 101 shown in FIG. 4 to FIG. 6 from the upper side to the lower side. As a result, the impeller 75 receives a paper sheet S transported by one of the lower extended part 27Ba and the three branch extended parts 27Bb of the branch transport constituent part 27B corresponding thereto, and feeds out into the accommodating part 14.

As shown in FIG. 7, the sliding stage part supporting member 111 mentioned above is connected to the peripheral supporting member 141. More specifically, the sliding stage part supporting member 111 is connected to the drive system supporting plate part 144 side end part of the shaft supporting plate part 143 via a connection plate 155. As shown in FIG. 4 to FIG. 6, the sliding stage part supporting member 111 extends along the intermediate extended plate part 145 of the peripheral supporting member 141, and is arranged so as to face the intermediate extended plate part 145. The sliding stage part supporting member 111, the connection plate 155, and the peripheral supporting member 141 are connected to each other. The sliding stage part supporting member 111, the connection plate 155, and the peripheral supporting member 141 form a U shape as a whole in plan view. On the inner side of the peripheral supporting member 141, the connection plate 155, and the sliding stage part supporting member 111, there are provided the bottom part constituent member 101, the supporting shaft supporting member 104, the impeller supporting shaft 103, the two impellers 75, the back wall part constituent member 102, and the sliding stage part 81. The sides of the sliding stage part supporting member 111 and the peripheral supporting member 141 opposite to the shaft supporting plate part 143 are positioned immediately rear of the opening part 15 of the accommodating part 14 shown in FIG. 1 and FIG. 3.

Figure 8:
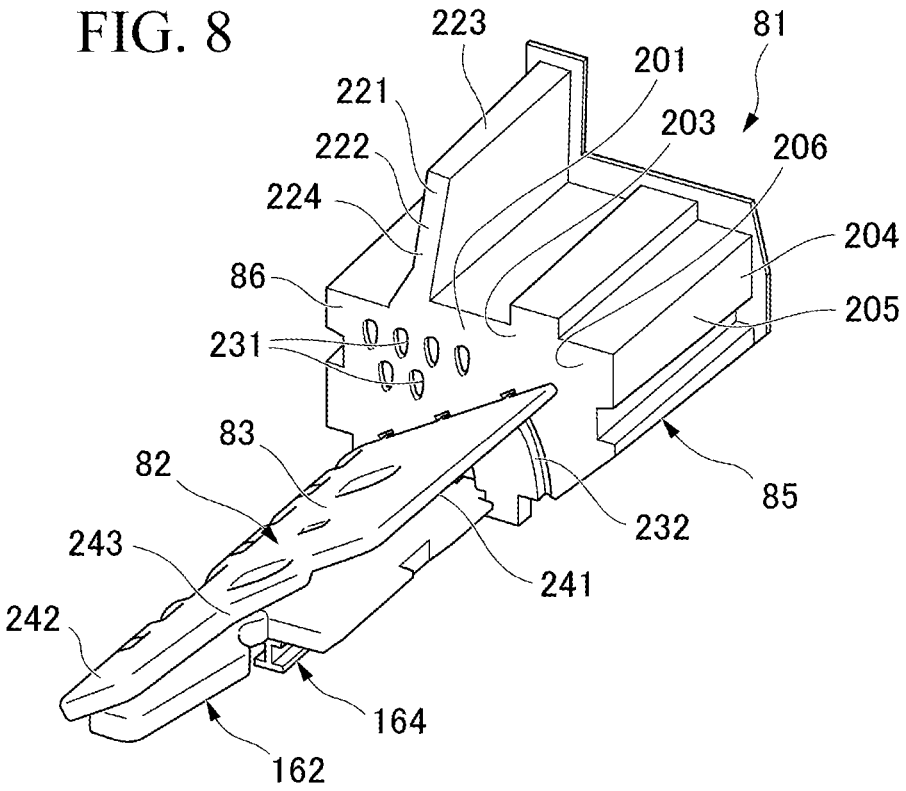
FIG. 8 is a perspective view showing the sliding stage part of the paper sheet processing device according to the one embodiment of the present invention.
Figure 9:
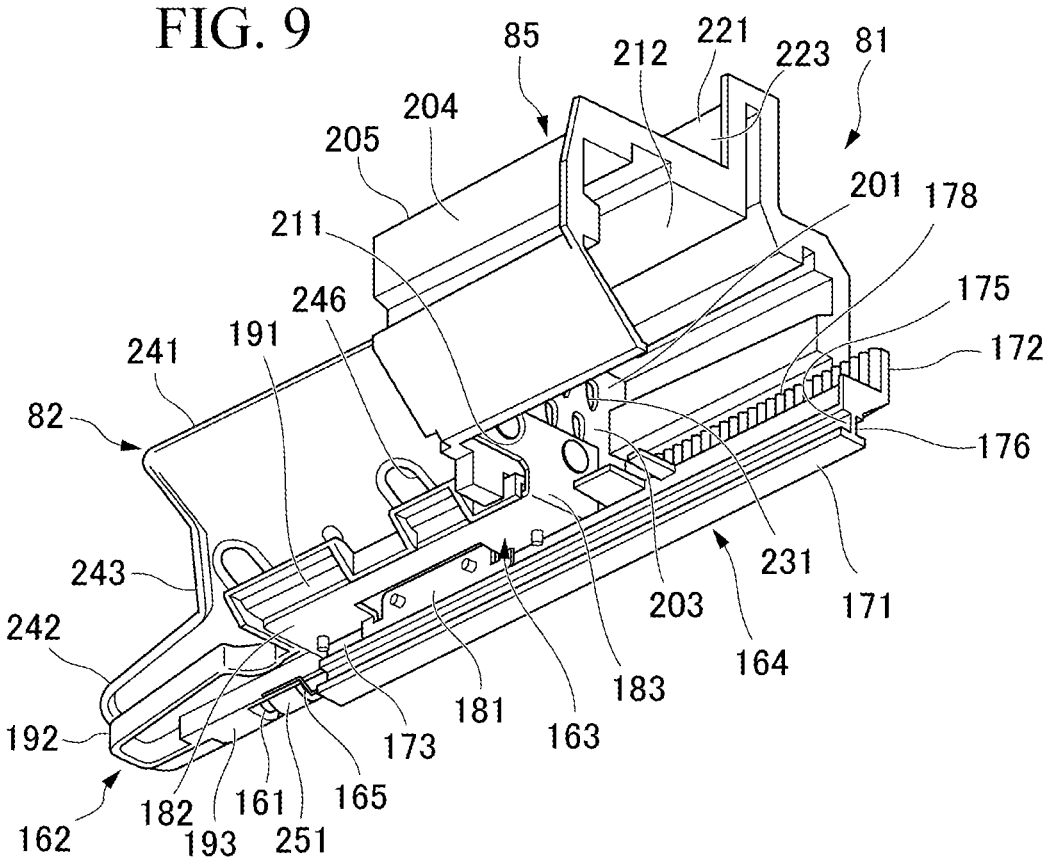
FIG. 9 is a perspective view showing the sliding stage part of the paper sheet processing device according to the one embodiment of the present invention.

As shown in FIG. 8, the sliding stage part 81 has the supporting stage 82 and the push-out stage 85 mentioned above. As shown in FIG. 9, the sliding stage part 81 further includes a stage supporting shaft 161, a base stage 162, a bracket 163, a rail member 164, and a biasing member 165. The stage supporting shaft 161 supports the supporting stage 82. The base stage 162 supports the stage supporting shaft 161. The bracket 163 supports the push-out stage 85 and the base stage 162. The rail member 164 supports the bracket 163.

The bracket 163 is fixed to the rail member 164. The push-out stage 85 and the base stage 162 are fixed to the bracket 163. Therefore, the rail member 164, the bracket 163, the push-out stage 85, and the base stage 162 are integrally fixed. The supporting stage 82 swings with respect to the base stage 162 by rotating about the stage supporting shaft 161. That is to say, the supporting stage 82 can swing with respect to the base stage 162. The central axis of the stage supporting shaft 161 serves as the swing center of the supporting stage 82.

The rail member 164 has a rail part 171, a rack gear part 172, and a bracket attachment part 173. The rail part 171 extends linearly. The rack gear part 172 is provided on one side of the rail part 171 in the extending direction. The bracket attachment part 173 is provided on the other side of the rail part 171 in the extending direction, and the bracket 163 mentioned above is attached thereto. The rack gear part 172 and the bracket attachment part 173 are provided in line in the extending direction of the rail part 171 on the same side in the direction orthogonal to the extending direction of the rail part 171. In the rail part 171 there are formed a pair of rail grooves 175, 176 extending in the extending direction thereof and each opening in opposite directions. The cross section of the rail part 171 on the plane orthogonal to the extending direction is of an H shape. The rack gear part 172 has a number of tooth parts 178 arranged in a straight line in the extending direction of the rail part 171. The one rail groove 175 opens in the same direction as the direction in which the tooth parts 178 of the rack gear part 172 are facing. The other rail groove 176 opens in a direction opposite to the direction in which the tooth parts 178 are facing.

The bracket 163 has a rail member attachment part 181, a base stage attachment part 182, and a push-out stage attachment part 183. The rail member attachment part 181 is attached to the bracket attachment part 173 of the rail member 164. The base stage attachment part 182, in the state of being attached to the rail member 164, extends in the direction in which the pair of rail grooves 175, 176 extend, being the direction in which the pair of rail grooves 175, 176 are lined up. The push-out stage attachment part 183 extends in the direction opposite to the rail part 171 and perpendicularly to the base stage attachment part 182 from the end part of the base stage attachment part 182 on the rack gear part 172 side in the state of being attached to the rail member 164. The push-out stage attachment part 183 extends in a direction orthogonal to the extending direction of the rail part 171.

Figure 10:
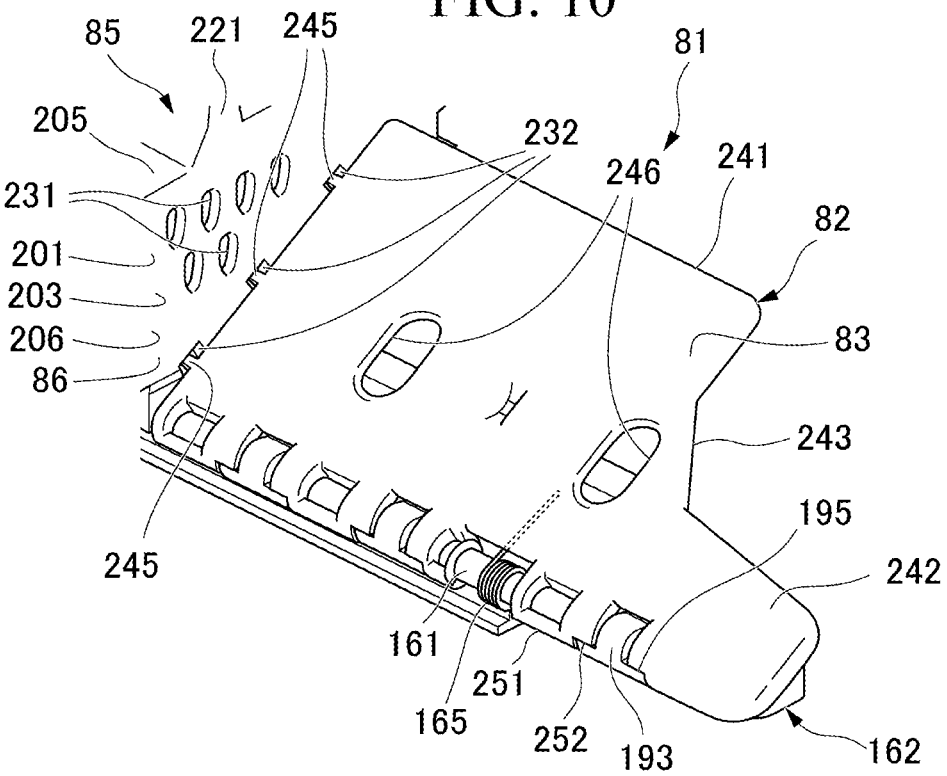
FIG. 10 is a partial perspective view showing the sliding stage part of the paper sheet processing device according to the one embodiment of the present invention.
Figure 11:
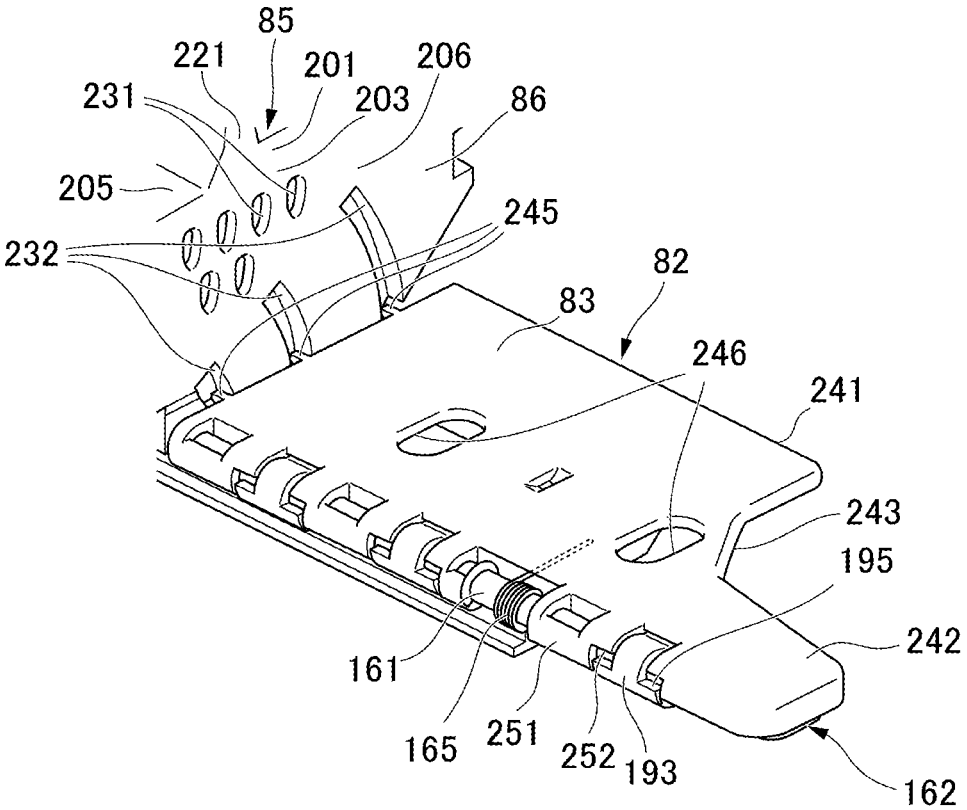
FIG. 11 is a partial perspective view showing the sliding stage part of the paper sheet processing device according to the one embodiment of the present invention.

The base stage 162 is a plate-shaped member made of a synthetic resin, and has a bracket attachment part 191 and a base extended part 192. The bracket attachment part 191 is attached to the base stage attachment part 182 of the bracket 163. The base extended part 192 extends from the bracket attachment part 191 in the direction opposite to the rack gear part 172 in a state of being attached to the bracket 163. The base stage 162 extends in a direction of connecting the bracket attachment part 191 and the base extended part 192. The base stage 162 has, at an edge part on one side along the extending direction thereof, a shaft supporting part 193 that supports the stage supporting shaft 161 so as to extend along this edge part. As shown in FIG. 10 and FIG. 11, the base stage 162 has, in the vicinity of the shaft supporting part 193, a base-side abutting part 195 that regulates the swing of the supporting stage 82.

The push-out wall part 201 has the push-out surface 86 mentioned above. The portion of the push-out stage 85 opposite to the push-out surface 86 is fixed to the push-out stage attachment part 183 of the bracket 163 as shown in FIG. 9. The push-out stage 85 has a main wall part 203 and a main body part 204. The main wall part 203 forms a part of the push-out wall part 201 and is attached to the bracket 163. The main body part 204 extends from the peripheral edge part of the main wall part 203 in the direction opposite to the base stage 162 while being attached to the bracket 163. The main wall part 203 and the main body part 204 form a main push-out part 205. As shown in FIG. 8, the surface of the main wall part 203 opposite to the main body part 204 is a main push-out surface 206 that forms a part of the push-out surface 86. As shown in FIG. 9, the portion of the main body part 204 on the rail member 164 side has a body part opening 211. The cross section of the main body part 204 in a plane parallel with the main wall part 203 is substantially of a U shape. The inside of the main body part 204 is a space part 212. This space part 212 communicates to the rail member 164 side via the body part opening 211.

The push-out stage 85 has an extended push-out part 221 extending in the direction opposite to the rail member 164 from the side of the main push-out part 205 opposite to the rail member 164. As shown in FIG. 8, the extended push-out part 221 has an extended wall part 222 and an extended body part 223. The extended wall part 222 extends in substantially the same direction as the extending direction of the main wall part 203 to form a part of the push-out wall part 201. The extended body part 223 extends from the peripheral edge part of the extended wall part 222 to the same side as the main body part 204. The portion of the extended wall part 222 opposite to the extended body part 223 is an extended push-out surface 224. The main wall part 203 and the extended wall part 222 form the push-out wall part 201. The extended push-out surface 224 is arranged substantially on the same plane as the main push-out surface 206. The extended push-out surface 224 and the main push-out surface 206 form the push-out surface 86 of the push-out wall part 201.

As shown in FIG. 10 and FIG. 11, the main wall part 203 has a plurality of through holes 231 at positions in the vicinity of the base end of the extended push-out part 221. The plurality of through holes 231 penetrate the main wall part 203 in the thickness direction. On the side opposite to the extended push-out part 221, the main wall part 203 has a plurality of, specifically, three guide grooves 232. Each guide groove 232 is of an arc shape and is recessed below the main push-out surface 206. These guide grooves 232 are of an arc shape with the same central angle centered on the stage supporting shaft 161, which is supported by the base stage 162.

The supporting stage 82 is a plate-shaped member made of a synthetic resin, and has a main plate part 241 and a protruding part 242. The length of the protruding part 242 in the longitudinal direction of the main plate part 241 is shorter than that of the main plate part 241. The protruding part 242 protrudes from one side in the longitudinal direction of the main plate part 241 in the extending direction of the main plate part 241. The supporting stage 82 has the supporting surface 83 on the main plate part 241 and the protruding part 242. In the supporting stage 82, the edge part of the main plate part 241 on the protruding part 242 side and the edge part of the protruding part 242 connected to the edge part form a cutaway part 243 having a cutaway shape. Accordingly, the supporting stage 82 has a shape in which the protruding part 242 and the cutaway part 243 are lined up. The supporting stage 82 has a plurality of, specifically, three engaging protrusions 245 protruding in the direction opposite to the protruding part 242 from the edge part on the side opposite to the protruding part 242 of the main plate part 241.

In the main plate part 241 there are formed a plurality of, specifically, two through holes 246. Each through hole 246 penetrates the main plate part 241 in the plate thickness direction thereof. The length of the main plate part 241 in the longitudinal direction is slightly shorter than the length of the long side of a paper sheet S having the shortest long side among paper sheets S that are identified by the paper sheet processing device 1 and are accommodatable in the accommodating part 14. Moreover, the total length of the main plate part 241 and the protruding part 242 of the supporting stage 82 in the longitudinal direction is longer than the length of the long side of a paper sheet S having the longest long side among paper sheets S that are identified by the paper sheet processing device 1 and are accommodatable in the accommodating part 14. The width of the protruding part 242 in the direction of connecting the protruding part 242 and the cutaway part 243 is shorter than the length of the short side of the paper sheet S.

The supporting stage 82 has a supporting shaft connecting part 251 at an edge part on the side where the main plate part 241 and the protruding part 242 are continuous. The supporting shaft connecting part 251 is connected to the stage supporting shaft 161 which is supported by the base stage 162. The supporting stage 82 is swingably supported by the base stage 162 by being connected to the stage supporting shaft 161. The supporting stage 82 has a supporting side abutting part 252 in the vicinity of the supporting shaft connecting part 251. As shown in FIG. 10, the supporting side abutting part 252 is in contact with the base-side abutting part 195 of the base stage 162. In the state where the supporting side abutting part 252 is in contact with the base-side abutting part 195, the angle formed by the supporting stage 82 and the base stage 162 is an acute angle (for example, approximately 30 degrees). The supporting stage 82 can swing in the direction in which the angle formed by the supporting stage 82 and the base stage 162 is reduced, from this being-in-contact state to the state of overlapping with the base stage 162 as shown in FIG. 11. The base stage 162 fits within the range of the supporting stage 82 when overlapping with the supporting stage 82.

The biasing member 165 is a torsion spring having a coil portion through the inside of which the stage supporting shaft 161 is inserted, one arm portion that is in contact with the base stage 162, and the other arm portion that is in contact with the supporting stage 82. The biasing member 165 biases the supporting stage 82 and the base stage 162 so as to be a basic state in which the supporting side abutting part 252 of the supporting stage 82 comes into contact with the base-side abutting part 195 of the base stage 162. In other words, the biasing member 165 biases the supporting stage 82 and the base stage 162 so that the supporting stage 82 separates from the base stage 162. The supporting stage 82 swings against the biasing force of the biasing member 165 from this basic state to the maximum swing state where the angle between the supporting stage 82 and the base stage 162 is minimized and the supporting stage 82 overlaps with the base stage 162.

In the state where the supporting stage 82 is supported by the base stage 162 via the stage supporting shaft 161, the plurality of engaging protrusions 245 each enter corresponding one of the plurality of guide grooves 232 of the base stage 162. The guide grooves 232 are formed at a central angle corresponding to the turning angle of the engaging protrusions 245 within the entire swing range of the supporting stage 82.

As shown in FIG. 4 to FIG. 6, the sliding stage part supporting member 111 extends in the direction inclined with respect to the horizontal direction, and specifically, extends upwards to the right in a state of being inclined by 45 degrees with respect to the horizontal direction. As shown in FIG. 7, two guide rollers 261, 262 and one guide roller 263 are attached to the sliding stage part supporting member 111 on the impeller 75 side, which is the upper side thereof. The height-wise position of the guide roller 261 is aligned with the height-wise position 262 of the guide roller 262. The height-wise position of the guide roller 263 is above the height-wise positions of the guide rollers 261, 262. This one guide roller 263 is arranged at the center position between the two guide rollers 261, 262. These guide rollers 261 to 263 project upward to the left from the sliding stage part supporting member 111 in a state of being inclined by 45 degrees with respect to the horizontal direction.

The sliding stage part 81 is supported by these guide rollers 261 to 263 by having the guide roller 263 enter the rail groove 175 of the rail member 164 and having the guide rollers 261, 262 enter the rail groove 176. The guide rollers 261 to 263 support the rail part 171 so as to extend in the horizontal front-rear direction, so that the sliding stage part 81 can slide in the extending direction of the rail part 171, that is, in the horizontal front-rear direction. In other words, the guide rollers 261 to 263 are arranged so that the supported sliding stage part 81 slides in the front-rear direction. These guide rollers 261 to 263 form a part of the accommodating part 14. Therefore, the sliding stage part 81 is slidably provided in the accommodating part 14.

The sliding stage part 81 is supported by these guide rollers 261 to 263, with the supporting stage 82 and the base stage 162 arranged on the front side of the push-out stage 85. As a result, the sliding stage part 81 is supported by the guide rollers 261 to 263, has the supporting stage 82 and the base stage 162 in front thereof, has the push-out stage 85 in rear thereof, and slides in the front-rear direction. At that time, in the sliding stage part 81, the rail member 164, the bracket 163, the push-out stage 85, and the base stage 162 move integrally in the front-rear direction, and the supporting stage 82 also moves integrally with them in the front-rear direction. The sliding stage part supporting member 111 and the guide rollers 261 to 263 form a stage supporting part 265 that slidably supports the sliding stage part 81.

In the state of being supported by the stage supporting part 265, the sliding stage part 81 is in a state where the base stage 162 is inclined 45 degrees with respect to the horizontal direction and extends upward to the right. Moreover, in this state, as shown in FIG. 4 to FIG. 6, the stage supporting shaft 161 of the sliding stage part 81, the shaft supporting part 193 of the base stage 162, and the supporting shaft connecting part 251 of the supporting stage 82 are arranged so as to enter the stepped portion formed by the extended part 125 and the attachment part 126 of the bottom part constituent member 101. Also, in this state, the sliding stage part 81 positions the supporting stage 82 on the impeller 75 side than the base stage 162; the push-out stage 85 has the main push-out part 205 on the supporting stage 82 side; and the sliding stage part 81 causes the extended push-out part 221 to extend to the opposite side of the supporting stage 82 than the main push-out part 205.

In the state where the supporting stage 82 (the sliding stage part 81) is supported by the stage supporting part 265, when the supporting stage 82 is in the basic state with respect to the base stage 162 as shown in FIG. 4, the supporting surface 83 of the supporting stage 82 extends upward to the right from the stage supporting shaft 161, which is the center of swinging. That is to say, the supporting surface 83 of the supporting stage 82 extends diagonally upward from the swing center in the state of facing upward. At this time, the protruding part 242 is positioned on the lower side of the supporting stage 82, and the cutaway part 243 is positioned on the upper side of the supporting stage 82.

In the state where the supporting stage 82 (the sliding stage part 81) is supported by the stage supporting part 265, when the supporting stage 82 is in the maximum swing state with respect to the base stage 162 as shown in FIG. 5, the supporting surface 83 of the supporting stage 82 is substantially flush with the upper surface 123 of the supporting wall part 122. Even in this maximum swing state, the supporting surface 83 of the supporting stage 82 extends upward to the right from the stage supporting shaft 161, which is the swing center, as in the basic state. That is to say, even in the maximum swing state, the supporting surface 83 of the supporting stage 82 extends diagonally upward from the swing center in the state of facing upward. However, the angle between the supporting surface 83 of the supporting stage 82 and the upper surface 71 of the accommodating bottom part 70 in the maximum swing state is greater than the angle between the supporting surface 83 of the supporting stage 82 and the upper surface 71 of the accommodating bottom part 70 in the basic state.

In the state where the sliding stage part 81 is supported by the stage supporting part 265, as shown in FIG. 7, the rack gear part 172 is arranged between the sliding stage part supporting member 111 and the drive system supporting plate part 144 of the peripheral supporting member 141. On the side opposite to the sliding stage part supporting member 111, a stage driving motor 271, which is a stepping motor, is attached to the drive system supporting plate part 144 of the peripheral supporting member 141 so that a driving shaft 272 thereof protrudes to the sliding stage part supporting member 111 side via the drive system supporting plate part 144. A driving gear 273 is fixed to the driving shaft 272 of the stage driving motor 271 at a portion protruding toward the sliding stage part supporting member 111 side than the drive system supporting plate part 144. A gear supporting shaft 281 is attached to the drive system supporting plate part 144 below the driving shaft 272. To a portion of the gear supporting shaft 281 that protrudes toward the sliding stage part supporting member 111 side, a pinion gear 282 is attached. The pinion gear 282 has a large gear part 283 and a small gear part 284. The large gear part 283 is a large gear part 283 that meshes with the driving gear 273. The small gear part 284 meshes with the rack gear part 172. The number of teeth of the small gear part 284 is less than the number of teeth of the large gear part 283.

Thereby, when the stage driving motor 271 rotates in the forward or reverse direction, the driving gear 273 rotates and drives the pinion gear 282, causing the pinion gear 282 to linearly drive the rack gear part 172. As a result, the sliding stage part 81 moves forward and backward. The driving gear 273, the gear supporting shaft 281 and the pinion gear 282 form a stage transmission part 285 that transmits the driving force of the stage driving motor 271 to the sliding stage part 81.

Here, when the sliding stage part 81 moves backward, the drive system supporting plate part 144, the stage driving motor 271, and the stage transmission part 285 including the driving gear 273, the gear supporting shaft 281 and the pinion gear 282 enter the space part 212 in the main body part 204 of the push-out stage 85. At this time, the small gear part 284 of the pinion gear 282 that meshes with the rail part 171 of the rail member 164 on the outer side of the push-out stage 85 avoids interference with the push-out stage 85 by means of the body part opening 211 of the main body part 204. Thus, when the sliding stage part 81 moves backward, the main body part 204 of the push-out stage 85 causes the drive system supporting plate part 144, the stage driving motor 271 and the stage transmission part 285 to be accommodated in the space part 212 thereinside.

The sliding stage part 81 slides between the retraction end position shown in FIG. 4 and FIG. 5 and the advancement end position shown in FIG. 6 and FIG. 7. As shown in FIG. 4 and FIG. 5, when the sliding stage part 81 is at the retraction end position, the supporting stage 82 overlaps totally with the bottom part constituent member 101 in the front-rear direction, and the position of the front end part of the supporting stage 82 aligns with the position of the front end part of the bottom part constituent member 101. Moreover, when the sliding stage part 81 is at the advancement end position shown in FIG. 6 and FIG. 7, the supporting stage 82 overlaps partially with the bottom part constituent member 101 in the front-rear direction, however, the front end part of the supporting stage 82 is positioned in front of the front end part of the bottom part constituent member 101. At this time, in the supporting stage 82, the protruding part 242 protrudes forward than the bottom part constituent member 101. However, as shown in FIG. 7, the main plate part 241 does not protrude forward than the bottom part constituent member 101.

As shown in FIG. 4 to FIG. 6, the accommodating back wall part 73 of the back wall part constituent member 102 is arranged between the main push-out part 205 of the push-out stage 85 and the intermediate extended plate part 145 of the peripheral supporting member 141. In the accommodating back wall part 73 there is formed an insertion groove 291 through which the extended push-out part 221 of the push-out stage 85 is inserted when the sliding stage part 81 advances and retracts. When the sliding stage part 81 is at the retraction end position shown in FIG. 4 and FIG. 5, the push-out surface 86 of the push-out stage 85 is substantially flush with the back wall surface 74 of the accommodating back wall part 73. When the sliding stage part 81 advances from this state toward the advancement end position shown in FIG. 6, the push-out surface 86 is positioned on the front side of the back wall surface 74.

When the sliding stage part 81 is in the waiting state where it is positioned at the retraction end position as shown in the first, third, and fourth sliding stage parts 81 from the top in FIG. 3, the entire sliding stage part 81 is positioned behind the opening part 15 of the accommodating part 14. Moreover, as shown with the second sliding stage part 81 from the top in FIG. 3, when the sliding stage part 81 is in the push-out state where it is positioned at the advancement end position, the protruding part 242, which is a part of the supporting stage 82, protrudes to the front side of the opening part 15 of the accommodating part 14. Note that also when the sliding stage part 81 is in the advancement end position, the main plate part 241 of the supporting stage 82 is positioned behind the opening part 15.

When feeding out paper sheets S to the accommodating part 14, as shown in FIG. 4, while the sliding stage part 81 is in the waiting state where it is at the retraction end position, in the accommodating part 14, the impeller driving motor 152, in synchronization with the driving of the transport part 30, causes the impeller supporting shaft 103 and the two impellers 75 to rotate via the impeller transmission part 151. Then, the blades 76 of the impeller 75 sandwich paper sheets S having been transported one by one at intervals by the transport part 30, and the impeller 75 rotates together with the paper sheets S. Then, the paper sheets S come in contact with the upper surface 71 of the accommodating bottom part 70 and eject from between the blades 76. After that, the impeller 75 pushes the paper sheets S to the supporting stage 82 side by means of the blades 76. Thereby, the paper sheet S is supported by the accommodating bottom part 70 in the state where the short side thereof is substantially aligned with the vertical direction and the long side of the lower end thereof is in contact with the upper surface 71 of the accommodating bottom part 70, and the paper sheet S is guided by the upper surface 71 and moves toward the supporting surface 83 side of the supporting stage 82. As a result, the paper sheet S is supported by the upper surface 123 and the supporting surface 83 while the long side of the lower end thereof is in contact with the upper surface 123 of the supporting wall part 122 of the bottom part constituent member 101 and the surface thereof on one side in the thickness direction is overlapping with the supporting surface 83.

Similarly, the paper sheet S fed out next is supported by the accommodating bottom part 70 in the state where the short side thereof is substantially aligned with the vertical direction and the long side of the lower end thereof is in contact with the upper surface 71 of the accommodating bottom part 70, and the paper sheet S is guided by the upper surface 71 and moves toward the supporting surface 83 side of the supporting stage 82. As a result, the paper sheet S is supported by the supporting stage 82 in the state where the surface on one side thereof in the thickness direction overlaps with the surface on the other side in the thickness direction of the paper sheet S having already been supported by the supporting stage 82. In this way, the paper sheets S are sequentially accumulated in the thickness direction. At this time, the paper sheets S are accumulated on the supporting stage 82 so as to approach the push-out surface 86 on the front side of the push-out surface 86 of the push-out stage 85. Thus, the sliding stage part 81 supports the paper sheets S in the state where the supporting stage 82 is in contact with the surface of one side of the paper sheets S in the thickness direction. The supporting stage 82 can swing.

When nothing is placed on the supporting stage 82 or when the number of paper sheets S placed on it is small, the supporting stage 82 is in the basic state as shown in FIG. 4. When the number of accumulated paper sheets S supported by the supporting stage 82 increases as the paper sheets S are fed out to the accommodating part 14, the load applied to the supporting stage 82, which is inclined with respect to the vertical direction, increases, and the supporting stage 82 swings toward the base stage 162 side as shown in FIG. 5 against the biasing force of the biasing member 165 according to the number of accumulated paper sheets S. In other words, the supporting stage 82 swings so as to approach the base stage 162 and gradually descends as the number of placed paper sheets S increases. In this way, when the supporting stage 82 swings with respect to the base stage 162 and the push-out stage 85, the supporting stage 82 makes a turning movement while the three engaging protrusions 245 are each in the state of having entered the guide grooves 232 corresponding thereto in a one-to-one manner. In this way, the accommodating part 14 accommodates the paper sheets S, and at that time, in the sliding stage part 81, the supporting stage 82 supports the paper sheets S accommodated in the accommodating part 14. At this time, the engaging protrusions 245 entering the guide grooves 232 prevent the paper sheets S from being sandwiched between the supporting stage 82 and the push-out stage 85.

When the feeding out of the paper sheets S to the accommodating part 14 is finished in this manner, the impeller driving motor 152 stops, and the stage driving motor 271 linearly drives the sliding stage part 81 via the stage transmission part 285. That is to say, the stage driving motor 271 causes, via the drive gear 273, the pinion gear 282 to rotate, and the pinion gear 282 drives the sliding stage part 81 including the rack gear part 172 that meshes with the pinion gear 282. Then, with the guidance of the guide rollers 261 to 263, the sliding stage part 81 slides toward the advancement end position. The paper sheets S accumulated on the supporting stage 82 are also in contact with the upper surface 71 of the accommodating bottom part 70 and the upper surface 123 of the supporting wall part 122, positions of which are fixed. Therefore, at the initial stage of sliding of the sliding stage part 81, the paper sheets S temporarily stay at the same position due to friction with the upper surface 71 of the accommodating bottom part 70 and the upper surface 123 of the supporting wall part 122. After that, in the sliding stage part 81, the push-out surface 86 of the push-out stage 85 comes into contact with the rear end part of the paper sheets S accumulated on the supporting stage 82 and pushes the paper sheets S. Then, the sliding stage part 81 and the paper sheets S accumulated on the supporting stage 82 move forward together. The stage driving motor 271, which is a stepping motor, stops when it detects the sliding stage part 81 as having moved to the advancement end position based on the number of steps for example.

When the sliding stage part 81 has moved to the advancement end position, the protruding part 242 of the supporting stage 82, and the paper sheets S accumulated on the supporting stage 82 protrude from the opening part 15 of the accommodating part 14 as shown in FIG. 3. As a result, the user that is to remove paper sheets S from the accommodating part 14, by looking at the protruding part 242 and the paper sheets S protruding from the accommodating part 14, can easily confirm that paper sheets S of which accommodating part 14 have been pushed out.

In other words, the sliding stage part 81 slides until a part (a leading end part) thereof protrudes to the outside of the accommodating part 14, and pushes out the supported paper sheets S forward in the pushing-out direction until a part (a leading end part) thereof protrudes to the outside of the accommodating part 14. Here, the opening part 15 of the accommodating part 14 is formed in the front surface of the paper sheet processing device 1 and is open to the outside of the paper sheet processing device 1. Therefore, the sliding stage part 81 slides until a part thereof protrudes to the outside of the paper sheet processing device 1, and pushes out the supported paper sheets S forward in the pushing-out direction until a part thereof protrudes to the outside of the paper sheet processing device 1. Hereunder, the direction in which the sliding stage part 81 pushes out the paper sheets S is simply referred to as pushing-out direction. The push-out stage 85 can come into contact with the rear end part in the pushing-out direction of the paper sheets S supported by the supporting stage 82.

As the sliding stage part 81 moves forward in the pushing-out direction (toward the outside), the push-out stage 85 moves, integrally with the supporting stage 82, forward in the pushing-out direction at the same time, and pushes out the paper sheets S placed on the supporting stage 82 to the outside by means of the main push-out part 205. The push-out stage 85 is provided with the extended push-out part 221 that extends to the opposite side of the supporting stage 82 than the main push-out part 205. As shown in FIG. 6, the extended push-out part 221 extends into the peripheral trajectory of the impeller 75. As a result, the extended push-out part 221 can push out the paper sheets S in the accommodating part 14, such as paper sheets S remaining on the impeller 75, in a position at which they cannot be pushed out by the main push-out part 205. Note that even if the sliding stage part 81 moves to the advancement end position, the extended push-out part 221 is arranged on the rear side (back side) of the impeller 75 as a whole so as not to come into contact with the impeller 75.

In the sliding stage part 81, the protruding part 242 that protrudes forward in the pushing-out direction and the cutaway part 243 are provided in line at the front end part thereof in the pushing-out direction. The protruding part 242 is arranged on the lower left side of the front end part of the sliding stage part 81, and the cutaway part 243 is arranged on the upper right side of the front end part of the sliding stage part 81, respectively. As shown in FIG. 7, the cutaway part 243 causes a part of the paper sheets S placed on the sliding stage part 81 to protrude to the outside of the sliding stage part 81.

That is to say, in the sliding stage part 81, the distance from the push-out surface 86 of the push-out stage 85 to the end part of the main plate part 241 of the supporting stage 82 on the protruding part 242 side is shorter than the shortest long side of paper sheets among the paper sheets that are identified by the paper sheet processing device 1 and are accommodatable in the accommodating part 14. Moreover, the distance from the upper surface 71 of the accommodating bottom part 70 to the side opposite to the upper surface 71 of the protruding part 242 is shorter than the short side length of paper sheets S with the shortest short side among the paper sheets that are identified by the paper sheet processing device 1 and are accommodatable in the accommodating part 14. Therefore, in the case of paper sheets S that are identified by the paper sheet processing device 1 and are accommodatable in the accommodating part 14, if the paper sheets S are supported by the accommodating bottom part 70 and the supporting stage 82 and are in contact with the push-out surface 86, a corner part thereof on the front end side and a part of the long side and the short side in the vicinity of the corner part protrudes to the outside from the supporting stage 82 by means of the cutaway part 243.

At this time, since the cutaway part 243 is positioned on the upper side of the protruding part 242, the upper side corner part of the front end part of the paper sheets S protrudes to the outside from the supporting stage 82. The cutaway part 243 is provided so as to: cause a corner part of the upper front part of paper sheets S having the shortest short side among the paper sheets S that are identified by the paper sheet processing device 1 and are accommodatable in the accommodating part 14, and the long side and the short side in the vicinity of the corner part to protrude to the outside from the supporting stage 82; and cause a corner part of the upper front part of paper sheets S having the shortest long side among the paper sheets S that are identified by the paper sheet processing device 1 and are accommodatable in the accommodating part 14, and the long side and the short side in the vicinity of the corner part to protrude to the outside from the supporting stage 82.

As a result, the user that is to remove paper sheets S from the accommodating part 14 can remove the paper sheet S by grabbing, from the right and upper side of the paper sheet processing device 1, the front part of the paper sheets S in the vicinity of the corner part on the right and upper side from the long-side side. Needless to say, it is also possible to remove paper sheets S by grabbing, from the front side of the paper sheet processing device 1, the front part of the paper sheets S in the vicinity of the corner part on the right and upper side from the short-side side. When paper sheets S are removed from the accommodating part 14, the paper sheets S are no longer present on the supporting stage 82. As a result, the supporting stage 82 turns by means of the biasing force of the biasing member 165 until the supporting side abutting part 252 comes into contact with the base-side abutting part 195 of the base stage 162, returning to the maximum turning state. Moreover, when a residual detection sensor (omitted in the drawings) provided in the accommodating part 14 or the sliding stage part 81 detects the paper sheets S on the supporting stage 82 as having been removed, the stage driving motor 271 linearly drives the sliding stage part 81 via the stage transmission part 285 to return the sliding stage part 81 to the retraction end position. When the sliding stage part 81 is positioned at the retraction end position, the stage driving motor 271 stops.

The paper sheet processing device 1 one by one takes into the apparatus, paper sheets S loaded in the receiving part 11 of the counting unit 2, and transports the paper sheets S taken in from the receiving part 11 by means of the transport part 30. Then, the paper sheets S being transported by the transport part 30 are identified by the identification part 22 provided in the transport part 30, and the paper sheets S identified by the identification part 22 are classified by type into the corresponding accommodating parts 14 of the accommodating unit 3 and accommodated so that they can be removed to the outside.

Prior to starting the processing of classifying, the types of paper sheets S as counting target paper sheets to be accommodated in each accommodating part 14 is set in the paper sheet processing device 1. The paper sheet processing device 1 counts paper sheets S and classifies them according to this setting. In one example, the first accommodating part 14, which is one of the plurality of accommodating parts 14, is set to accommodate 10,000-yen banknotes as paper sheets S that have been counted by the identification part 22. The second accommodating part 14, which is another of the accommodating parts 14, is set to accommodate 5,000-yen banknotes as paper sheets S that have been counted by the identification part 22. Also, the third accommodating part 14, which is another of the accommodating parts 14, is set to accommodate 1,000-yen banknotes as paper sheets S that have been counted by the identification part 22. Also, the fourth accommodating part 14, which is another of the accommodating parts 14, is set to accommodate 2,000-yen banknotes as paper sheets S that have been counted by the identification part 22. The 10,000-yen note, the 5,000-yen note, the 1,000-yen note, and the 2,000-yen note are types of banknotes issued by Bank of Japan. Note that, prior to starting the processing of classifying, all of the accommodating parts 14 are in the waiting state where the sliding stage part 81 is at the retraction end position.

When paper sheets S are set in the receiving part 11 in the accumulated state and the start operation is input to the operation display part 31, the control part 32 causes the taking-in part 55 to separate the accumulated paper sheets S one by one and feed them out to be taken into the paper sheet processing device 1, and causes the transport part 30 to transport the paper sheets S Immediately after the transport part 30 starts the transport, the detection part 23 provided in the vicinity of the receiving part 11 detects the transport state of the paper sheets S. If the transport state of the paper sheets S detection part 23 is rejected paper sheets in an abnormal transport state including double feeding, skewing, and near feeding, the control part 32 does not count the paper sheets S, and controls the transport part 30 to transport the paper sheets S to the rejection part 13 to be accommodated therein.

On the other hand, if the transport state of the paper sheets S detected by the detection part 23 is the normal transport state having no double feeding, no skewing, and no near feeding, the control part 32 causes the identification main body part 24 on the downstream side of the detection part 23 of the identification part 22 to identify the paper sheets S. If the paper sheets S are identified, based on the identification result of the identification main body part 24, as rejected paper sheets having an identification abnormality including falsification, damage, tape attached, and abnormality found in ultraviolet inspection, the control part 32 also does not count the paper sheets S, and controls the transport part 30 to transport the paper sheets S to the rejection part 13 to be accommodated therein.

If the paper sheets S are identified by the identification main body part 24 as having no identification abnormality, the control part 32 controls the transport part 30 to transport the paper sheets S identified as having no identification abnormality to the accommodating part 14 of the destination thereof to be accommodated therein. In this accommodating part 14, the impeller 75 sandwiches paper sheets S transported by the transport part 30 between the blades 76 and rotates together with the paper sheets S, and after the paper sheets S are brought into contact with the upper surface 71 of the accommodating bottom part 70 and have come out from between the blades 76, pushes the paper sheets S toward the supporting stage 82 side by means of the blades 76. Then, the paper sheets S are guided by the upper surface 71 of the accommodating bottom part 70 and move to the supporting surface 83 side of the supporting stage 82 to be supported by the upper surface 123 of the supporting wall part 122 and the supporting surface 83 of the supporting stage 82.

Similarly, paper sheets S fed out next move to the supporting surface 83 side of the supporting stage 82 while being guided by the upper surface 71 of the accommodating bottom part 70, and overlap with and are supported on the paper sheets already supported by the supporting stage 82. Thus, the accommodating part 14 accommodates paper sheets S that are counted and identified as counting target paper sheets by the identification part 22, and the paper sheets S accommodated in the accommodating part 14 are sequentially accumulated on the upper surface 123 of the supporting wall part 122 and the supporting surface 83 of the supporting stage 82.

Here, as the number of accumulated paper sheets S supported by the supporting stage 82 increases as a result of the feeding of the paper sheets S into the accommodating part 14, the supporting stage 82 in the basic state swings against the biasing force of the biasing member 165 toward the base stage 162 side. At the retraction end position, the sliding stage part 81 accumulates, on the supporting stage 82, the paper sheets S that have been fed out to the accommodating part 14 in this manner.

Thus, each accommodating part 14 accommodates paper sheets of the type set as accommodating target paper sheets among the paper sheets S counted and identified by the identification part 22 as counting target paper sheets, and the rejection part 13 accommodates paper sheets S identified by the identification part 22 as rejected paper sheets. Thus, in the case where paper sheets S are no longer present in the receiving part 11 or where any of the accommodating parts 14 becomes full, the control part 32 causes the taking-in part 55 and the impeller driving motor 152 to stop, and drives the stage driving motor 271 to cause the sliding stage part 81 to slide toward the advancement end position. The paper sheets S initially accumulated on the supporting stage 82 temporarily stay in the same position due to friction with the upper surface 71 of the accommodating bottom part 70 and the upper surface 123 of the supporting wall part 122. After that, on the sliding stage part 81, the push-out surface 86 of the push-out stage 85 comes into contact with the rear end part of the paper sheets S accumulated on the supporting stage 82 and pushes the paper sheets S. Then, the sliding stage part 81 and the paper sheets S accumulated on the supporting stage 82 move forward together. The control part 32 causes the stage driving motor 271 to stop when the stage driving motor 271 has moved the sliding stage part 81 to the advancement end position.

When the sliding stage part 81 has moved to the advancement end position, the protruding part 242 of the supporting stage 82 and the paper sheets S accumulated on the supporting stage 82 protrude from the opening part 15 of the accommodating part 14. Note that at this time, the push-out stage 85 pushes the paper sheets S accumulated on the supporting stage 82 by means of the main push-out part 205. Moreover, the extended push-out part 221 pushes out the paper sheets S such as paper sheets S remaining on the impeller 75 in a position at which they cannot be pushed out by the main push-out part 205.

On the sliding stage part 81, a part of the paper sheets S placed on the supporting stage 82 protrudes outward at the cutaway part 243 on the upper right of the front end part. As a result, the user grasps the upper right portion of the front end part that protrudes outward from the sliding stage part 81 due to the cutaway part 243, and takes out the paper sheets S from the accommodating part 14. When the paper sheets S are removed from the accommodating part 14, the supporting stage 82 swings until the supporting side abutting part 252 abuts against the base-side abutting part 195 by means of the biasing force of the biasing member 165, returning to the maximum turning state. Moreover, when the residual detection sensor (omitted in the drawings) detects the paper sheets S as being no longer present on the supporting stage 82, the control part 32 drives the stage driving motor 271 to return the sliding stage part 81 to the retraction end position. When the sliding stage part 81 is positioned at the retraction end position, the control part 32 stops the stage driving motor 271.

According to the paper sheet processing device 1 of the embodiment described above, when the accommodating part 14 accommodates paper sheets S, the paper sheets S accommodated in the accommodating part 14 are supported by the sliding stage part 81. The sliding stage part 81 slides until a part thereof protrudes to the outside of the accommodating part 14, and pushes out the supported paper sheets S forward in the pushing-out direction until a part thereof protrudes to the outside of the accommodating part 14. This means that the user will remove the paper sheets S that are partially protruding from the accommodating part 14, facilitating the removal of paper sheets S from the accommodating part 14. Therefore, it is possible to improve the workability when the user removes paper sheets S from the accommodating part 14.

Moreover, when the accommodating part 14 accommodates paper sheets S, the paper sheets S accommodated in the accommodating part 14 are supported by the sliding stage part 81. Then the sliding stage part 81 slides until a part thereof protrudes from the opening part 15 of the accommodating part 14 to the outside of the paper sheet processing device 1, and pushes the supported paper sheets S forward in the pushing-out direction until a part thereof protrudes from the opening part 15 of the accommodating part 14 to the outside of the paper sheet processing device 1. This means that the user will remove the paper sheets S that are partially protruding from the opening part 15 of the accommodating part 14 to the outside of the paper sheet processing device 1, facilitating the removal of paper sheets S from the accommodating part 14. Therefore, it is possible to improve the workability when the user removes paper sheets S from the paper sheet processing device 1.

Moreover, when paper sheets S accommodated in the accommodating part 14 are pushed out of the accommodating part 14, the protruding part 242 of the sliding stage part 81 on which paper sheets S are placed protrudes to the outside of the accommodating part 14. Therefore, the user can easily make a visual confirmation as to which paper sheets S have been pushed out by looking at the protruding part 242. Also, it is possible, by touching the protruding part 242 that has been protruded, to confirm which paper sheets S have been pushed out, using not only visual observation but also a hand.

Furthermore, since paper sheets S accommodated in the accommodating part 14 are pushed out of the accommodating part 14 in the state of being supported by the sliding stage part 81, it is possible to prevent paper sheets S that have been pushed out from falling.

Moreover, the sliding stage part 81 supports paper sheets S while being in contact with the surface on one side in the thickness direction of the paper sheets S, and, in the sliding stage part 81, the protruding part 242 that protrudes forward in the pushing-out direction and supports the paper sheets S, and the cutaway part 243 that causes the paper sheets S to protrude are provided in line at the front end part thereof in the pushing-out direction. Therefore, grabbing the protruding portion of paper sheets S at the cutaway part 243 facilitates removal of the paper sheets S from the accommodating part 14, enabling reliable removal of the paper sheets S.

Moreover, since the cutaway part 243 is provided on the upper side of the sliding stage part 81 that extends diagonally with respect to the horizontal direction, removal of paper sheets S from the accommodating part 14 becomes even easier.

Furthermore, since the supporting stage 82 that comes in contact with the surface on one side in the thickness direction of paper sheets S and that supports the paper sheets S while accumulating them in the thickness direction can swing and extends diagonally upward from the swing center, it swings according to the amount of paper sheets S accumulated. Therefore, the volume of the accumulation space inside the accommodating part 14 can be reduced when the amount of paper sheets S is small, and the volume of the accumulation space of the accommodating part 14 can be increased when the number of paper sheets S increases. Therefore, it is possible to prevent increase in the range of movement within the accommodating part 14 allowed for paper sheets S that are initially fed out into the accommodating part 14 from the transport part 30, and it is possible to cause the supporting stage 82 to reliably support the paper sheets S initially fed out into the accommodating part 14 from the transport part 30, and stabilize the posture of the paper sheets S. Furthermore, since the supporting stage 82 swings as the number of supported paper sheets S increases, even if the accumulation capacity of the accommodating part 14 increases, the paper sheets S fed out into the accommodating part 14 can be accumulated reliably.

Also, when the sliding stage part 81 slides forward in the pushing-out direction in the state where paper sheets S are accumulated in the thickness direction on the supporting stage 82, the push-out stage 85 that can come in contact with the rear end part in the pushing-out direction of the paper sheets S supported on the supporting stage 82 pushes out the paper sheets S accumulated on the supporting stage 82 forward in the pushing-out direction. At this time, the push-out stage 85 pushes out the paper sheets S accumulated on the supporting stage 82 by means of the main push-out part 205, and meanwhile, pushes out the paper sheets S on the side opposite of the push-out stage 85 in the accumulating direction of the paper sheets S than the main push-out part 205, by means of the extended push-out part 221 that extends from the main push-out part 205. Therefore, even if paper sheets S are in a position where they cannot be pushed out by the main push-out part 205 for some reason such as being caught by the impeller 75, the paper sheets S can still be pushed out.

The embodiment described above can be changed as in the following modified examples.

MODIFIED EXAMPLE 1, 2

In the embodiment, an example has been taken to describe the case where a plurality of accommodating parts 14 are provided lined up in the upper-lower direction while the front-rear and left-right positions thereof are aligned, however, it is not limited to such an example. As a modified example 1, a plurality of accommodating parts 14 may be provided lined up in the left-right direction while the front-rear and upper-lower positions thereof are aligned. As a modified example 2, they may be provided lined up in the front-rear direction while the left-right and upper-lower positions thereof are aligned.

MODIFIED EXAMPLE 3

In the embodiment, four accommodating parts 14 are provided in one accommodating unit 3, however, the present disclosure is not limited to such an example. As a modified example 3, three or five may be provided in one accommodation unit 3.

MODIFIED EXAMPLE 4

In the embodiment, an example has been taken to describe the case where one accommodating unit 3 is connected to one counting unit 2, however, the present disclosure is not limited to such an example. As a modified example 4, a plurality of accommodating units 3 may be connected to one counting unit 2.

MODIFIED EXAMPLE 5

In the embodiment, an example has been taken to describe the case where the sliding stage part 81 is moved to a certain advancement end position when the paper sheets S are pushed out, however, the present disclosure is not limited to such an example. As a modified example 5, the amount of movement of the sliding stage part 81 may be changed according to the size of paper sheets S accommodated in the accommodating part 14. Thus, it is possible, by controlling the sliding amount of the sliding stage part 81 according to the length in the pushing-out direction of paper sheets S supported, to cause the paper sheets S to protrude to a position that facilitates removal thereof, according to the length in the pushing-out direction. Therefore, removal of paper sheets S becomes even easier.

MODIFIED EXAMPLE 5-1

Figure 12A:
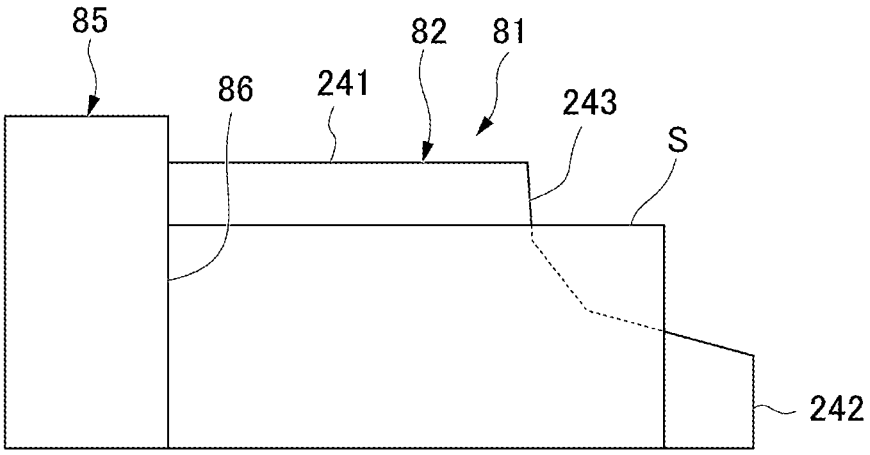
FIG. 12A is a diagram for describing an operation of a modified example 5 of the paper sheet processing device according to the one embodiment of the present invention.
Figure 12B:
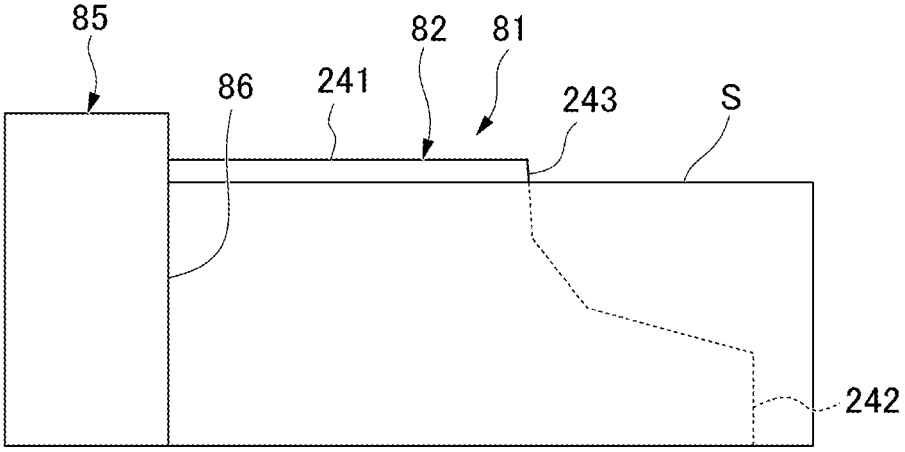
FIG. 12B is a diagram for describing an operation of the modified example 5 of the paper sheet processing device according to the one embodiment of the present invention.

For example, as shown in FIG. 12A and FIG. 12B as a modified example 5-1, the amount of protrusion of paper sheets S from the accommodating part 14 is set to be the same. Specifically, the number of steps of the stage driving motor 271, which is a stepping motor, is changed according to the size of paper sheets S accommodated in the accommodating part 14 on the basis of the size data of the paper sheets S obtained by the identification part 22 or stored preliminarily in the memory storage part 33, to thereby change the amount of movement of the sliding stage part 81 to an arbitrarily amount, so that the amount of protrusion of the paper sheets S from the accommodating part 14 is set to be the same. As a result, since the front side part (leading end part) of the paper sheets S stays at the same position when removing the paper sheets S, the user can remove the paper sheets S even more easily.

MODIFIED EXAMPLE 5-2

Figure 12C:
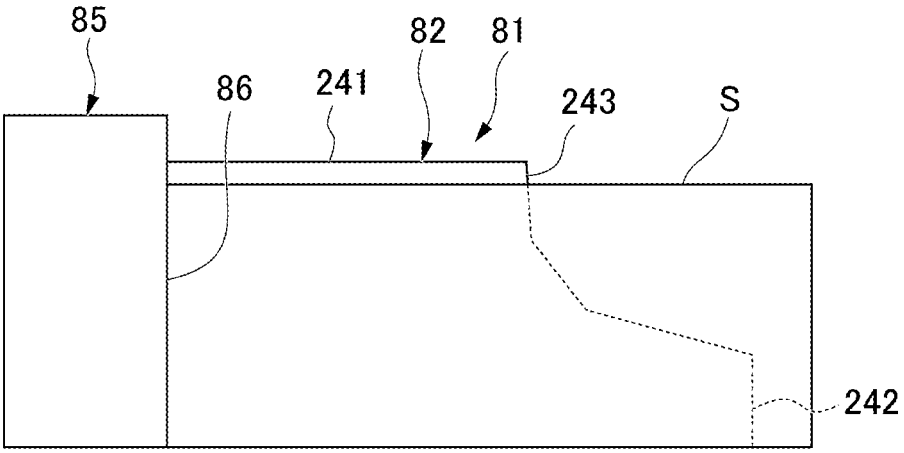
FIG. 12C is a diagram for describing an operation of the modified example 5 of the paper sheet processing device according to the one embodiment of the present invention.

Moreover, for example, as shown in FIG. 12A and FIG. 12C as a modified example 5-2, the maximum protruding positions of the sliding stage part 81 and the paper sheets S are aligned as a whole. For example, when pushing out paper sheets S, the location of maximum protrusion is the leading end part of the protruding part 242 in the case where the paper sheets S are smaller than or equal to the supporting stage 82 in the pushing-out direction, as shown in FIG. 12A. On the other hand, as shown in FIG. 12C, in the case where the paper sheets S are larger than the supporting stage 82 in the pushing-out direction, the location of maximum protrusion is the leading end part of the paper sheets S. Accordingly, the number of steps of the stage driving motor 271, which is a stepping motor, is changed according to the size of paper sheets S accommodated in the accommodating part 14 on the basis of the size data of the paper sheets S obtained by the identification part 22 or stored preliminarily in the memory storage part 33, to thereby change the amount of movement of the sliding stage part 81 to an arbitrarily amount, so that the amount of protrusion at the maximum protrusion location is set to stay the same according to the size of the paper sheets S accommodated in the accommodating part 14. As a result, the amount of protrusion of the portion protruding from each accommodating part 14 becomes the same regardless of paper sheets S accommodated, so that it is possible to prevent the portion protruding outward from catching a user's hand, and workability and safety can be improved.

MODIFIED EXAMPLE 5-3

As a modified example 5-3, the movement amount of the sliding stage part 81 may be changed for each accommodating part 14, and in the case where a plurality of accommodating units 3 are provided, the movement amount of the sliding stage part 81 may be changed for each accommodating unit 3. For example, the number of steps of the stage driving motor 271, which is a stepping motor, is changed to thereby change the amount of movement of the sliding stage part 81 to an arbitrary amount. Thereby, the protrusion amount of the sliding stage part 81, the protrusion amount of paper sheets S, or the protrusion amount of the sliding stage part 81 and the paper sheets S as a whole is increased as approaching the lower stage from the upper stage or as approaching the upper stage from the lower stage.

MODIFIED EXAMPLE 6

In the embodiment, in a situation where paper sheets S need to be removed after the paper sheets S have been accommodated in the accommodating part 14, the control part 32 automatically causes the sliding stage part 81 to push out the paper sheets S, however, the present disclosure is not limited to such an example. For example, as a modified example 6, when the user inputs an operation of requesting a banknote push-out into the operation display part 31 after they have been accommodated, the paper sheets S may be pushed out from the accommodating part 14 thereof by means of the sliding stage part 81.

MODIFIED EXAMPLE 7-1

As a modified example 7-1, immediately after having pushed out paper sheets S, the sliding stage part 81 may be returned to the retraction end position without waiting for the paper sheets S to be removed. By accumulating paper sheets S diagonally (for example, at 45 degrees) on the sliding stage part 81, the load of the paper sheets S is also distributed to the side of the accommodating bottom part 70, which is a sheet metal, and the load applied to the supporting stage 82 is reduced. Therefore, even if the sliding stage part 81 is returned to its original position, the paper sheets S do not move from the position after having been pushed out. Accordingly, the sliding stage part 81 is separated from the paper sheets S after the paper sheets S have protruded, and the portion of the paper sheets S protruding from the sliding stage part 81 increases. As a result, it is highly unlikely that the sliding stage part 81 becomes an obstacle when the paper sheets S are to be grabbed. Therefore, paper sheets S of a particularly small size can easily be removed.

MODIFIED EXAMPLE 7-2

Figure 13:
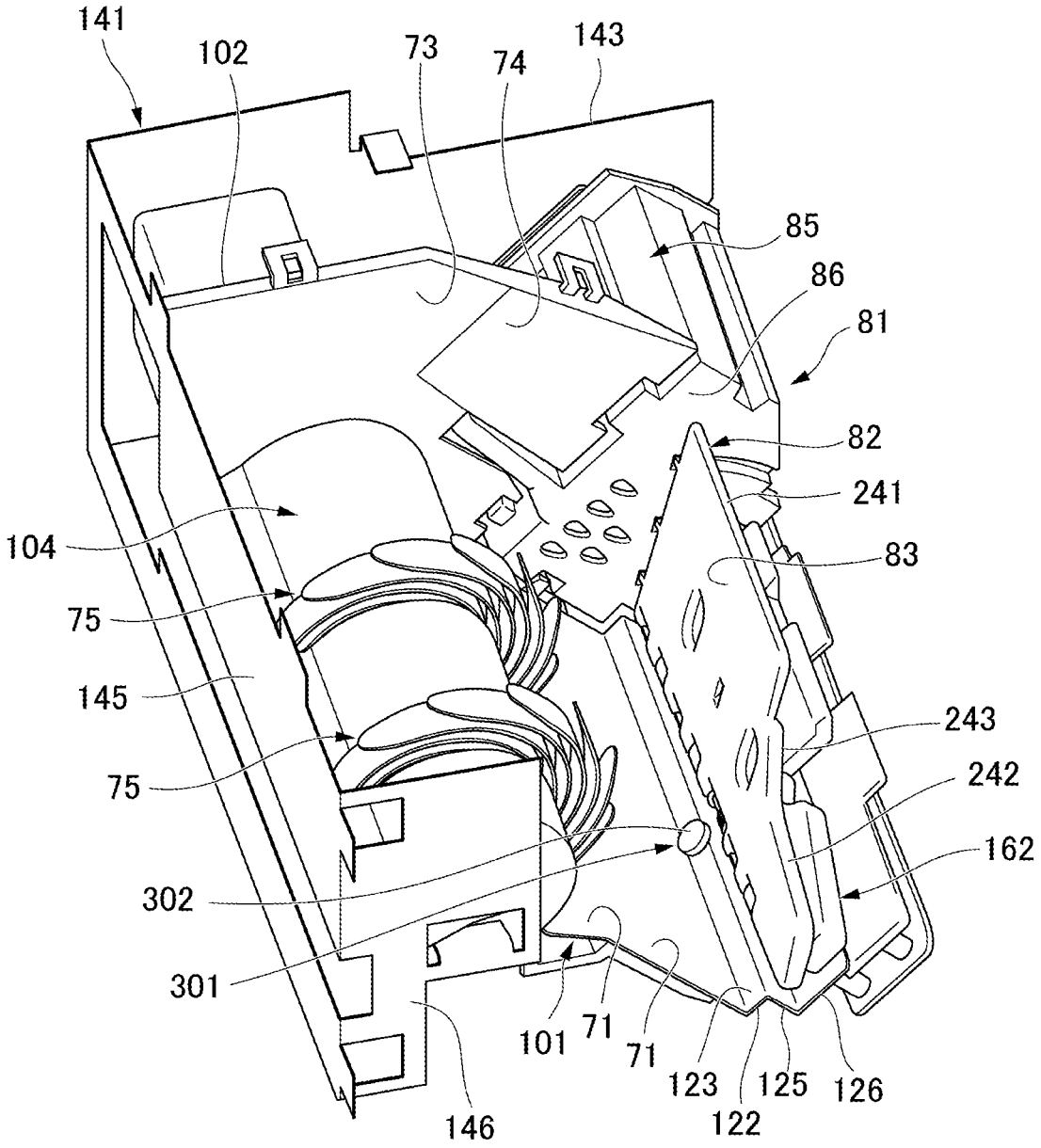
FIG. 13 is a perspective view showing an accommodating part and a sliding stage part of a modified example 7-2 of the paper sheet processing device according to the one embodiment of the present invention.
Figure 14:
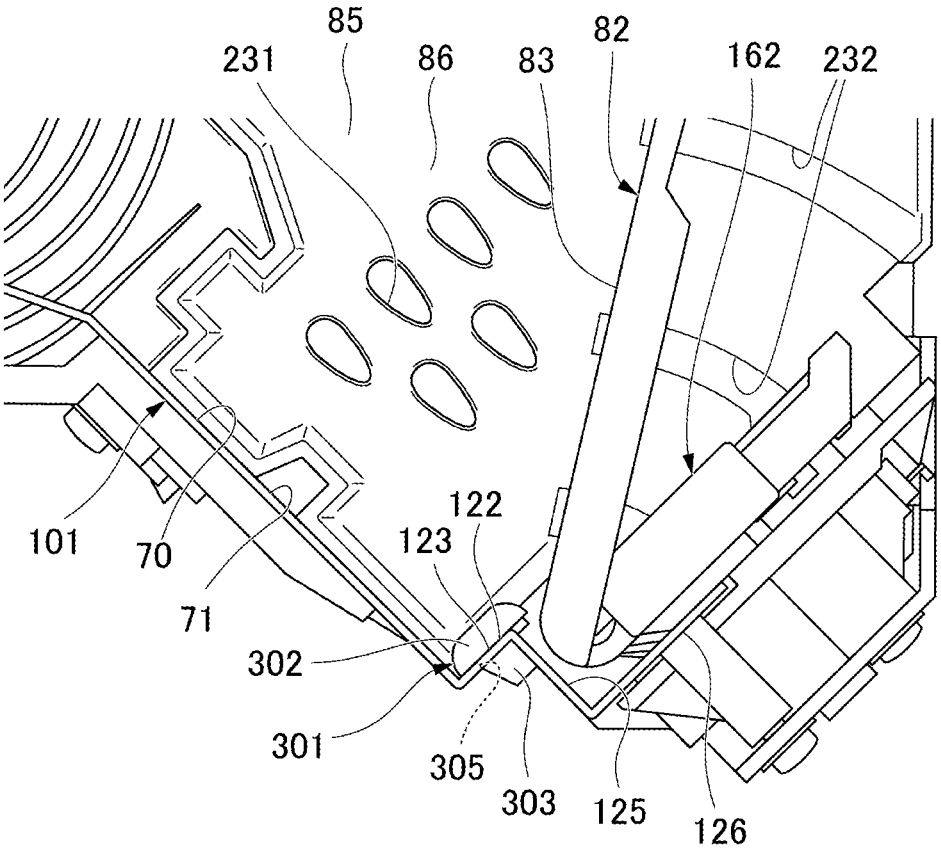
FIG. 14 is a partial front elevation view showing the accommodating part and the sliding stage part of the modified example 7-2 of the paper sheet processing device according to the one embodiment of the present invention.

As a modified example 7-2, in the case where, immediately after paper sheets S have been pushed out, the sliding stage part 81 is returned to the retraction end position without waiting for the paper sheets S to be removed, as shown in FIG. 13 and FIG. 14, a high friction part (a high friction member) 301, such as a rubber, having a friction coefficient higher than that of the supporting wall part 82, which is made of a synthetic resin, and higher than that of the supporting wall part 122, which is a sheet metal, is provided on the upper surface 123 of the supporting wall part 122 of the bottom part constituent member 101, the position of which is fixed. As a result, the high friction part 301 comes into contact with the paper sheet S that is in contact with the supporting stage 82. The high friction part 301 is a separate member from the bottom part constituent member 101, and has a dome-shaped head part 302 and an attachment part 303 having a diameter smaller than that of the head 302. The high friction part 301 is fixed to the bottom part constituent member 101 by fitting the attachment part 303 into an attachment hole 305 formed in the bottom part constituent member 101. The high friction part 301 comes into contact with paper sheets S at the head part 302.

According to the modified example 7-2, even if the sliding stage part 81 retracts into the accommodating part 14 without waiting for paper sheets S to be removed immediately after the sliding stage part 81 has pushed out the paper sheets S accumulated on the supporting stage 82 forward in the pushing-out direction by means of the push-out stage 85, the paper sheets S do not move due to the high friction part 301, the position of which is fixed with respect to the accommodating part 14, and maintain the state of partially protruding from the accommodating part 14. Accordingly, the sliding stage part 81 is separated from the paper sheets S after the paper sheets S have protruded, and the portion of the paper sheets S protruding from the sliding stage part 81 increases. As a result, it is highly unlikely that the sliding stage part 81 becomes an obstacle when the paper sheets S are to be grabbed. Therefore, removal of the paper sheets S becomes even easier.

A first aspect according to the present invention is a paper sheet processing device including: an accommodating part that accommodates a paper sheet; and a sliding stage part that is provided within the accommodating part and supports the paper sheet accommodated within the accommodating part, the sliding stage part sliding with respect to the accommodating part to cause a portion of the sliding stage part to protrude to outside of the accommodating part, and the sliding stage part sliding with respect to the accommodating part to push the paper sheet to the outside of the accommodating part and cause a leading end of the paper sheet to protrude to the outside of the accommodating part.

According to the above first aspect, when the accommodating part accommodates a paper sheet, the paper sheet accommodated in the accommodating part are supported by the sliding stage part. Then, a part of the sliding stage part protrudes to the outside of the accommodating part, and a part of the paper sheet protrudes to the outside of the accommodating part. Therefore, removal of the paper sheet, a part of which is protruding from the accommodating part, becomes possible, thereby facilitating the removal of the paper sheet from the accommodating part.

A second aspect of the present invention is such that in the paper sheet processing device of the above first aspect, the sliding stage part includes: a protruding part that supports the leading end of the paper sheet, and that protrudes to the outside of the accommodating part by the sliding stage part sliding with respect to the accommodating part; and a cutaway part provided alongside the protruding part.

According to the above second aspect, grabbing the exposed portion of a paper sheet in the cutaway part further facilitate removal of the paper sheet from the accommodating part.

A third aspect of the present invention is such that in the paper sheet processing device of the above first or second aspects, the sliding stage part includes a supporting surface that is inclined with respect to a horizontal direction and that supports the paper sheet.

According to the above third aspect, the supporting surface is inclined with respect to the horizontal direction, and it is therefore easier to remove a paper sheet from the accommodating part.

A fourth aspect of the present invention is such that in any one of the above first to third aspects, the sliding stage part swings around an axis along a direction in which the sliding stage part slide, according to an amount of the paper sheet supported by the sliding stage part.

According to the above fourth aspect, the volume of the accumulation space inside the accommodating part can be reduced when the amount of paper sheets is small, and the volume of the accumulation space of the accommodating part can be increased when the number of paper sheets increases. Therefore, it is possible to prevent increase in the range of movement within the accommodating part allowed for paper sheets that are initially fed out into the accommodating part, and it is possible to cause the supporting stage to reliably support the paper sheets initially fed out into the accommodating part, and stabilize the posture of the paper sheets. Furthermore, since the sliding stage part swings as the number of supported paper sheets increases, even if the accumulation capacity of the accommodating part increases, banknotes fed out into the accommodating part can be accommodated reliably.

A fifth aspect of the present invention is such that in any one of the above first to fourth aspects, the sliding stage part includes: a supporting stage that supports the paper sheet; and a push-out stage that comes in contact with a rear end of the paper sheet, which is on an opposite side of the leading end of the paper sheet, and pushes the paper sheet to the outside of the accommodating part, and the push-out stage includes: a main push-out part including a pushing surface that comes into contact with the paper sheet; and an extended push-out part extending from the main push-out part in a direction substantially orthogonal to a direction in which the sliding stage part slides.

According to the above fifth aspect, when the push-out stage pushes paper sheets out of the accommodating part, then as a result of the main push-out part coining into contact with paper sheets that are in a position where they cannot come in contact with the main push-out part, the paper sheets can be pushed out.

A sixth aspect of the present invention is such that in any one of the above first to fifth aspects, the accommodating part includes: an upper surface that supports a side of the paper sheet; and a high friction member that is fixed to the upper surface, is in contact with a side of the paper sheet, and has a higher friction coefficient than that of the upper surface.

According to the above sixth aspect, even if the sliding stage part retracts into the accommodating part without waiting for paper sheets to be removed after a part of the paper sheets is made to protrude to the outside of the accommodating part, the paper sheets remain in the same position as a result of being in contact with the high friction part, and maintain the state of partially protruding from the accommodating part. Therefore, the sliding stage part separates from the paper sheets after the sliding stage part has retracted into the accommodating part. As a result, it is highly unlikely that the sliding stage part becomes an obstacle when the paper sheets are to be grabbed. Therefore, removal of paper sheets from the accommodating part becomes even easier.

A seventh aspect of the present invention is such that in any one of the above first to sixth aspects, an amount of sliding that the sliding stage part makes with respect to the accommodating part is controlled according to a length of the paper sheet along a direction in which the sliding stage part slides.

According to the above seventh aspect, the sliding stage part is such that the amount of sliding with respect to the accommodating part is controlled according to the length of the paper sheets along the direction in which the sliding stage part slides. Therefore, it is possible to have paper sheets to protrude to a position that facilitates removal of paper sheets according to the length of the paper sheets. Therefore, removal of paper sheets from the accommodating part becomes even easier.

INDUSTRIAL APPLICABILITY

The present invention may be applied to a paper sheet processing device.

REFERENCE SYMBOLS

1 Paper sheet processing device
14 Accommodating part
15 Opening part
81 Sliding stage part
82 Supporting stage
85 Push-out stage
205 Main push-out part
221 Extended push-out part
242 Protruding part
243 Cutaway part
301 High friction part
S Paper sheets

The invention claimed is:

1. A paper sheet processing device comprising:

an accommodating part that accommodates a paper sheet; and a sliding stage part that is accommodated within the accommodating part and supports the paper sheet accommodated within the accommodating part, a movable portion of the sliding stage part sliding in a first direction with respect to the accommodating part to cause the movable portion of the sliding stage part to protrude to outside of the accommodating part, the sliding stage part sliding in the first direction with respect to the accommodating part to push the paper sheet to the outside of the accommodating part and cause a leading end of the paper sheet to protrude to the outside of the accommodating part, the sliding stage part sliding in a second direction with respect to the accommodating part and being housed within the accommodating part after the sliding stage part slides in the first direction, the second direction being opposite to the first direction, wherein the accommodating part includes:

an upper surface that supports a side of the paper sheet, a position of the upper surface being maintained when the sliding stage part slides in the first direction and in the second direction; and a high friction member that is fixed to the upper surface, is in contact with the side of the paper sheet, and has a higher friction coefficient than that of the upper surface, and wherein the high friction member maintains a position of the paper sheet when the sliding stage part slides in the second direction, to cause the leading end of the paper sheet to be maintained to be protruded to the outside of the accommodating part.

2. The paper sheet processing device according to claim 1, wherein the sliding stage part includes:

a protruding part that supports the leading end of the paper sheet, and that protrudes to the outside of the accommodating part by the sliding stage part sliding in the first direction with respect to the accommodating part; and a cutaway part provided alongside the protruding part.

3. The paper sheet processing device according to claim 1, wherein the sliding stage part includes a supporting surface that is inclined with respect to a horizontal direction and that supports the paper sheet.

4. The paper sheet processing device according to claim 1, wherein the sliding stage part swings around an axis along the first direction, according to an amount of the paper sheet supported by the sliding stage part.

5. The paper sheet processing device according to claim 1, wherein the sliding stage part includes:

a supporting stage that supports the paper sheet; and a push-out stage that comes in contact with a rear end of the paper sheet, which is on an opposite side of the leading end of the paper sheet, and pushes the paper sheet to the outside of the accommodating part, and the push-out stage includes:

a main push-out part including a pushing surface that comes into contact with the paper sheet; and an extended push-out part extending from the main push-out part in a direction substantially orthogonal to the first direction.

6. The paper sheet processing device according to claim 1, wherein an amount of sliding that the sliding stage part makes with respect to the accommodating part is controlled according to a length of the paper sheet along the first direction.

* * * * *